US008791674B2

(12) United States Patent
Moane

(10) Patent No.: US 8,791,674 B2
(45) Date of Patent: Jul. 29, 2014

(54) VOLTAGE REGULATING CIRCUIT AND A METHOD FOR PRODUCING A REGULATED DC OUTPUT VOLTAGE FROM AN UNREGULATED DC INPUT VOLTAGE

(75) Inventor: Brian Moane, Reheen (IE)

(73) Assignee: Analog Devices, Inc., Norwood, MA (US)

( * ) Notice: Subject to any disclaimer, the term of this patent is extended or adjusted under 35 U.S.C. 154(b) by 794 days.

(21) Appl. No.: 12/838,301

(22) Filed: Jul. 16, 2010

(65) Prior Publication Data

US 2012/0013320 A1 Jan. 19, 2012

(51) Int. Cl.
*G05F 1/40* (2006.01)
*G05F 1/565* (2006.01)

(52) U.S. Cl.
USPC ..... 323/275; 323/274

(58) Field of Classification Search
USPC ..... 323/228, 277, 270, 273, 283, 282, 288, 323/269, 274, 285, 275
See application file for complete search history.

(56) References Cited

U.S. PATENT DOCUMENTS

| | | | | |
|---|---|---|---|---|
| 5,528,127 | A | 6/1996 | Streit | |
| 6,005,303 | A | 12/1999 | Hawkes et al. | |
| 6,141,193 | A | 10/2000 | Mercer | |
| 6,377,033 | B2 | 4/2002 | Hsu | |
| 6,469,480 | B2 | 10/2002 | Kanakubo | |
| 6,677,737 | B2 | 1/2004 | Hamon et al. | |
| 6,707,280 | B1 | 3/2004 | Liu et al. | |
| 6,920,571 | B2 | 7/2005 | Shaver et al. | |
| 6,946,849 | B1 * | 9/2005 | Lu | 324/601 |
| 6,989,660 | B2 * | 1/2006 | Mauthe | 323/274 |
| 7,106,032 | B2 | 9/2006 | Chen et al. | |
| 7,391,187 | B2 | 6/2008 | Rasmus | |
| 7,586,357 | B2 * | 9/2009 | Rentala et al. | 327/309 |
| 7,675,273 | B2 * | 3/2010 | Ko et al. | 323/269 |
| 2009/0066368 | A1 * | 3/2009 | Mei | 326/83 |

* cited by examiner

*Primary Examiner* — Matthew Nguyen
*Assistant Examiner* — Trinh Dang
(74) *Attorney, Agent, or Firm* — Knobbe, Martens, Olson & Bear LLP

(57) ABSTRACT

A voltage regulator receives an unregulated DC input voltage supply and provides a regulated DC output voltage. A primary pass element and an external resistor are located in a primary current path through which a load current flows from the input terminal to the output terminal. The voltage regulator includes two control circuits that control the impedances of two pass elements. Power dissipation can be improved and the dropout voltage can be reduced by maintaining the voltage on an internal node of the voltage regulator.

39 Claims, 10 Drawing Sheets

VOLTAGE REGULATING CIRCUIT AND A METHOD FOR PRODUCING A REGULATED DC OUTPUT VOLTAGE FROM AN UNREGULATED DC INPUT VOLTAGE

BACKGROUND

1. Field

The disclosed technology relates to voltage regulation, and in particular, to direct current (DC) voltage regulation.

2. Background

Voltage regulators for producing a regulated DC output voltage from an unregulated DC input voltage supply are known in the prior art. One such prior art voltage regulator which produces a regulated DC output voltage from an unregulated DC voltage supply is referred to as a linear voltage regulator. Such a prior art linear voltage regulator is illustrated in FIG. 1. The linear voltage regulator of FIG. 1 comprises a pair of input terminals 1 and 2 across which the unregulated DC voltage supply is applied, and a pair of output terminals 3 and 4 across which the regulated DC output voltage is produced and applied to a load 5. The input terminal 2 and the output terminal 4 are tied to a common voltage, typically ground voltage. The load current $I_l$ is drawn from the unregulated DC voltage supply and flows from the input terminal 1 to the output terminal 3 through a pass element 7 of variable impedance, which typically is provided by a field effect transistor M1.

A resistor-divider circuit 9 connected across the output terminals 3 and 4 produces a voltage on an intermediate tap 10 which is indicative of the output voltage produced across the output terminals 3 and 4. The voltage on the intermediate tap 10 is applied to one of an inverting input and a non-inverting input of an error amplifier 12, and a voltage reference $V_{ref}$ is applied to the other of the inverting input and the non-inverting input of the error amplifier 12 in order to produce a negative feedback loop with the pass element 7. In the voltage regulating circuit of FIG. 1 the voltage on the intermediate tap 10 is applied to the non-inverting input, and the voltage reference $V_{ref}$ is applied to the inverting input. The voltage reference $V_{ref}$ is of value substantially similar to the value of the voltage which should appear on the intermediate tap 10 when the output voltage produced across the output terminals 3 and 4 is at the correct regulated voltage value. The error amplifier 12 produces a control signal which is indicative of the difference between the voltage on the intermediate tap 10 and the voltage reference $V_{ref}$. The control signal is applied to the gate of the field effect transistor M1. The impedance of the field effect transistor M1 is responsive to the control signal from the error amplifier 12 for maintaining the output voltage produced across the output terminals 3 and 4 at the correct regulated voltage value.

Such linear voltage regulators as the prior art linear voltage regulator of FIG. 1 have many advantages, one of which is that they tolerate a relatively wide variation in the voltage of the unregulated DC voltage supply between the minimum voltage to which the unregulated voltage supply may drop and the maximum voltage to which the unregulated voltage supply may rise. Additionally, such linear voltage regulators operate with a relatively small voltage difference between the unregulated voltage supply and the regulated output voltage. In other words, the dropout voltage which is the voltage of the unregulated voltage supply at which the voltage regulator ceases to produce the regulated voltage is relatively low, and in general is of value just above the regulated voltage value.

However, a disadvantage of such linear voltage regulators is that since the load current $I_l$ is drawn through the pass element 7, the power dissipated by the pass element 7 is equal to the product of the load current $I_l$ by the voltage drop across the pass element. The voltage drop across the pass element is equal to the value of the voltage of the unregulated voltage supply less the value of the regulated output voltage. Thus, as the voltage of the unregulated voltage supply increases, the power dissipated by the pass element 7 also increases. Since the power dissipated by the pass element 7 is dissipated as heat, the heat produced by the pass element can be relatively high, and in particular, can be relatively high at the higher values of the voltage of the unregulated voltage supply. This is undesirable, and is particularly undesirable when the linear voltage regulator is implemented as an integrated circuit on a die due to the difficulty in dissipating heat from dies. The problem of heat dissipation is further aggravated when the load to which the regulated output voltage is being supplied is implemented as an integrated circuit on the same die or package as that on which the linear voltage regulator is formed.

Efforts have been made to address the problem of heat dissipation in prior art linear voltage regulators of the type illustrated in FIG. 1. A typical prior art linear voltage regulator which reduces heat dissipation on a die is illustrated in FIG. 2. In the linear voltage regulator of FIG. 2 a voltage dropping resistor $R_{ext}$ is provided in series with the pass element 7, but is located externally of the die. Thus, the external voltage dropping resistor $R_{ext}$ drops some of the voltage between the unregulated voltage supply and the regulated output voltage while the remainder of the voltage between the unregulated voltage supply and the regulated output voltage is dropped across the pass element. This in turn splits the power dissipated by the voltage regulator between the power dissipated by the pass element 7 in the die and the power dissipated by the external resistor $R_{ext}$ externally of the die. However, a problem with this voltage regulator is that the dropout voltage, in other words, the value of the unregulated voltage supply at which the voltage regulator ceases to produce the regulated output voltage is increased by the voltage drop across the external resistor $R_{ext}$.

Accordingly, the external resistor $R_{ext}$ should be selected to have a maximum resistance value sufficiently low that, at the minimum value of the unregulated voltage supply and when the current drawn by the load is a maximum, the voltage dropped across the external resistor $R_{ext}$ is such that the voltage regulator continues to produce the regulated output voltage. This, however, imposes a limitation on the size of the external resistor $R_{ext}$, and in turn the amount of heat which can be dissipated by the external resistor $R_{ext}$.

A computer simulation of the voltage regulator of FIG. 2 was carried out. The results of the computer simulation are illustrated by the graphs of FIG. 3 which are described below. In the computer simulation the voltage regulator was configured to operate with an unregulated voltage supply which varies between a minimum voltage value of 11 volts and a maximum voltage value of 25 volts, and to produce a regulated output voltage of 5 volts with a maximum load current of 50 mA. The resistance value of the external resistor $R_{ext}$ was selected to be sufficiently low that the voltage drop across the external resistor $R_{ext}$ was less than 6 volts. Otherwise, during periods when the unregulated voltage supply remained at its minimum voltage value, the voltage available to the pass element 7 would be insufficient for the voltage regulator to produce the regulated output voltage. In this case the resistance value of the external resistance was selected to be 120 ohms. Therefore, in this particular case when the unregulated supply voltage reached its maximum value of 25 volts, the voltage dropped across the external resistor $R_{ext}$ was still less than 6 volts, thus leaving a voltage of 14 volts to be dropped across the pass element 7. This resulted in a relatively high power dissipation by the pass element 7 in the form of heat, particularly at the relatively higher values of the unregulated input voltage.

Referring now in particular to FIG. 3, FIG. 3 illustrates three graphs which represent power dissipated by the voltage regulator of FIG. 2 plotted against the unregulated input voltage obtained from the computer simulation. In FIG. 3 power is plotted in watts on the vertical Y-axis, and the voltage of the unregulated input voltage is plotted in volts on the horizontal X-axis. Graph X represents a plot of the total power dissipated by the external resistor $R_{ext}$ and the pass element 7 of the voltage regulator of FIG. 2 as the unregulated input voltage varies between the minimum value of 11 volts and the maximum value of 25 volts. Graph Y represents the power dissipated internally in the voltage regulating circuit of FIG. 2 by the pass element 7 as the unregulated input voltage varies from the minimum value of 11 volts to the maximum value of 25 volts. Graph Z represents the power dissipated by the external resistor $R_{ext}$ as the unregulated input voltage varies from the minimum value of 11 volts to the maximum value of 25 volts. As can be seen from graph Y, the power dissipated by the pass element 7 increases from zero watts to approximately 0.7 watts as the unregulated input voltage varies from 11 volts to 25 volts. However, from graph Z it can be seen that the power dissipated by the external resistor $R_{ext}$ remains constant at approximately 0.3 watts as the unregulated input voltage varies between 11 volts and 25 volts. Thus, the total power dissipated by the external resistor $R_{ext}$ and the pass element 7, as can be seen from graph X of FIG. 3, varies from approximately 0.3 watts to 1 watt. Accordingly, at the maximum value of the unregulated input voltage of 25 volts, the pass element dissipates approximately 0.7 watts, and since all the power dissipated by the pass element 7 is dissipated in the form of heat, the heat dissipated internally in the voltage regulating circuit of FIG. 2 by the pass element 7 is approximately 0.7 watts. However, at the maximum value of 25 volts of the unregulated input voltage, the external resistor $R_{ext}$ is still only dissipating the same amount of power, namely, approximately 0.3 watts, as it dissipates when the unregulated input voltage is at its minimum value of 11 volts when virtually no heat is being dissipated by the pass element 7. This is clearly undesirable.

Thus, while the provision of the external resistor $R_{ext}$ assists to some extent in externally dissipating power and in turn heat produced by the linear voltage regulator of FIG. 2, its benefit is limited, particularly in cases where the unregulated voltage supply varies widely between an upper maximum voltage value and a lower minimum voltage value.

There is therefore a need for a voltage regulating circuit which produces a regulated DC output voltage from an unregulated DC voltage supply, which addresses the problem of power dissipation by prior art voltage regulators.

The present disclosure provides such a DC voltage regulating circuit, and the disclosure is also directed towards providing a method for producing a regulated DC output voltage from an unregulated DC voltage supply which addresses the problem of power dissipation of known voltage regulators.

SUMMARY

The disclosure provides a DC voltage regulating circuit having a pair of input terminals for receiving an unregulated DC input voltage, and a pair of output terminals across which a regulated DC output voltage is produced for applying to a load. The voltage regulating circuit includes a primary current path for accommodating current from a first one of the input terminals to a first one of the output terminals. The voltage regulating circuit also includes a primary pass element of variable impedance in the primary current path. A voltage dropping heat dissipating impedance element in the primary current path in series with the primary pass element and defining with the primary pass element a primary node therebetween in the primary current path is also included. The voltage regulating circuit additionally includes a bypass current path parallel with the primary current path bypassing the voltage dropping heat dissipating impedance element and a secondary pass element of variable impedance in the bypass current path. A primary control circuit is responsive to one of the voltage produced across the output terminals and the voltage on the primary node. If the primary circuit is responsive to the voltage produced across the output terminals, then the primary control circuit controls the impedance of the primary pass element to maintain the output voltage across the output terminals at the regulated voltage value. If the primary circuit is responsive to the voltage on the primary node, then the primary circuit controls the impedance of the primary pass element to control the voltage on the primary node. A secondary control circuit is responsive to the other one of the voltage produced across the output terminals and the voltage on the primary node. If the secondary circuit is responsive to the voltage produced across the output terminals, then the secondary control circuit controls the impedance of the secondary pass element to maintain the output voltage across the output terminals at the regulated voltage value. If the secondary circuit is responsive to the voltage on the primary node, then the secondary circuit controls the impedance of the secondary pass element to control the voltage on the primary node.

In one embodiment of the invention, the primary control circuit is responsive to the voltage produced across the output terminals for controlling the impedance of the primary pass element to maintain the output voltage across the output terminal at the regulated voltage value, and the secondary control circuit is responsive to the voltage on the primary node for controlling the impedance of the secondary pass element to control the voltage on the primary node.

In one aspect of the invention, the primary control circuit comprises a first comparing means for comparing a first voltage indicative of the output voltage produced across the output terminals with a second voltage, and for producing a first control signal indicative of the difference between the first voltage and the second voltage.

In another aspect of the invention, the second voltage is derived from a first voltage reference.

Preferably, the first control signal is applied to the primary pass element, and the impedance of the primary pass element is responsive to the first control signal.

In another aspect of the invention, the first voltage indicative of the output voltage is derived from a first intermediate tap defined by a first impedance-divider circuit connected across the output terminals through a first current path. Preferably, the first impedance-divider circuit comprises at least two first electrically resistive elements between which the first intermediate tap is defined.

Advantageously, the first comparing means comprises a first error amplifier for producing the first control signal, the first voltage indicative of the output voltage being applied to one of an inverting input and a non-inverting input of the first error amplifier, and the second voltage being applied to the other of the inverting input and the non-inverting input of the first error amplifier to produce a negative feedback loop with the primary pass element.

Preferably, the primary pass element comprises a first transistor accommodating the primary current path therethrough, the first transistor being responsive to the first control signal for varying the impedance in the primary current path through the first transistor. Desirably, the first transistor comprises a first field effect transistor having a source, a drain and a gate, the primary current path extending through the first field effect transistor between the source and the drain, and the first control signal being applied to the gate thereof.

In another aspect of the invention the secondary control circuit comprises a second comparing means for comparing a third voltage indicative of the voltage on the primary node with a fourth voltage, and for producing a second control signal indicative of the difference between the third voltage and the fourth voltage.

In one aspect of the invention, the fourth voltage is derived from a voltage reference, and preferably, the voltage reference from which the fourth voltage is derived may be one of the first voltage reference and a second voltage reference.

In one embodiment of the invention, the voltage reference from which the fourth voltage is derived is the second voltage reference.

In an alternative embodiment of the invention, the fourth voltage is derived from a variable voltage, and preferably, the fourth voltage is derived from a variable voltage reference.

In another alternative embodiment of the invention, the fourth voltage is programmable.

In a further alternative embodiment of the invention, the fourth voltage is derived from the unregulated input voltage.

In another embodiment of the invention, the fourth voltage is selectable.

Advantageously, the second control signal is applied to the secondary pass element, and the impedance of the secondary pass element is responsive to the second control signal.

In one embodiment of the invention, the third voltage is derived from a second intermediate tap defined by a second impedance-divider circuit connected through a second current path between the primary node and a common voltage at which the second ones of the input and output terminals are held. Preferably, the second impedance-divider circuit comprises at least two second electrically resistive elements defining the second intermediate tap therebetween.

In one embodiment of the invention, the second comparing means comprises a second error amplifier for producing the second control signal, the third voltage being applied to one of an inverting input and a non-inverting input of the second error amplifier, and the fourth voltage being applied to the other of the inverting input and the non-inverting input of the error amplifier to produce a negative feedback loop with the secondary pass element.

In another embodiment of the invention, the secondary pass element comprises a second transistor accommodating the bypass current path therethrough, the second transistor being responsive to the second control signal for varying the impedance in the bypass current path through the second transistor. Preferably, the second transistor comprises a second field effect transistor having a source, a drain and a gate, the bypass current path extending through the second field effect transistor between the source and the drain, and the second control signal being applied to the gate thereof.

Preferably, the voltage dropping heat dissipating impedance element is located in the primary current path between the first input terminal and the primary pass element.

Alternatively, the primary control circuit is responsive to the voltage on the primary node for controlling the impedance of the primary pass element to control the voltage on the primary node, and the secondary control circuit is responsive to the voltage produced across the output terminals for controlling the impedance of the secondary pass element to maintain the output voltage across the output terminals at the regulated voltage value.

In one aspect of the invention, the primary control circuit comprises a first comparing means for comparing a third voltage indicative of the voltage on the primary node with a fourth voltage, and for producing a first control signal indicative of the difference between the third voltage and the fourth voltage.

Preferably, the fourth voltage is derived from one of a voltage reference and the unregulated input voltage.

Advantageously, the first comparing means compares the third voltage indicative of the voltage on the primary node with the unregulated input voltage.

Desirably, the first control signal is applied to the primary pass element, and the impedance of the primary pass element is responsive to the first control signal.

In one aspect of the invention, the secondary control circuit comprises a second comparing means for comparing a first voltage indicative of the voltage produced across the output terminals with a second voltage, and for producing a second control signal indicative of the difference between the first voltage and the second voltage.

In another aspect of the invention, the second voltage is derived from one of a voltage reference and the unregulated input voltage.

Preferably, the second voltage is derived from a first voltage reference.

Advantageously, the second control signal is applied to the secondary pass element, and the impedance of the secondary pass element is responsive to the second control signal.

In another embodiment of the invention, the voltage dropping heat dissipating impedance element is located in the primary current path between the primary node and the first output terminal.

In one aspect of the invention, the voltage on the primary node is controlled so that the relationship between heat dissipated by the voltage dropping heat dissipating impedance element and the unregulated input voltage is a quadratic relationship.

In another aspect of the invention, the voltage on the primary node is controlled so that the relationship between heat dissipated by the primary and secondary pass elements and the unregulated input voltage is a quadratic relationship.

Desirably, with the exception of the voltage dropping heat dissipating impedance element the voltage regulating circuit is implemented as an integrated circuit on one or more dies, the voltage dropping heat dissipating impedance element being located externally of the one or more dies.

In another embodiment of the invention, the one or more dies on which the integrated circuit is implemented is located in a package, and the voltage dropping heat dissipating impedance element is located externally of the package.

The disclosure also provides an integrated circuit formed on one or more dies comprising the voltage regulating circuit according to the invention formed on the one or more dies with the exception of the voltage dropping heat dissipating impedance element, and a load formed on the one or more dies supplied with the regulated output voltage from the voltage regulating circuit, the voltage dropping heat dissipating impedance element being located externally of the one or more dies.

Further the disclosure provides an integrated circuit formed on one or more dies comprising the voltage regulating circuit according to the invention with the exception of the voltage dropping heat dissipating impedance element, and a load formed on one of the one or more dies and another die in a package comprising the one or more dies on which the voltage regulating circuit is formed, the load being supplied with the regulated output voltage from the voltage regulating circuit, the voltage dropping heat dissipating impedance element being located externally of the package.

Additionally the disclosure provides a method for producing a regulated DC output voltage from an unregulated DC input voltage, the method comprising:

providing a primary current path in a voltage regulating circuit for accommodating current from a first one of a pair of input terminals to a first one of a pair of output terminals, providing a primary pass element of variable impedance in the primary current path, providing a voltage dropping heat dissipating impedance element in the primary current path in series with the primary pass element to define with the primary pass element a primary node therebetween in the primary current path, providing a bypass current path parallel with the primary current path bypassing the voltage dropping heat dissipating impedance element, providing a secondary pass element of variable impedance in the bypass current path, controlling the impedance of the primary pass element in response to one of the voltage produced across the output terminals, for maintaining the output voltage across the output terminals at the regulated voltage value, and the voltage on the primary node, for controlling the voltage on the primary node; and controlling the impedance of the secondary pass element in response to the other of the voltage produced across the output terminals, for maintaining the output voltage across the output terminals at the regulated voltage value, and the voltage on the primary node, for controlling the voltage on the primary node.

DETAILED DESCRIPTION OF CERTAIN EMBODIMENTS

The advantages of the improved voltages regulators and voltage regulation methods disclosed herein are many. One advantage is that power, and in turn heat dissipated by the voltage dropping heat dissipating impedance element on the one hand, and power and in turn heat dissipated by the primary and secondary pass elements is optimized. This is advantageous when the voltage regulating circuit is implemented as an integrated circuit on a die and the voltage dropping heat dissipating impedance element is located externally of the die, since the heat dissipated externally of the die by the voltage dropping heat dissipating impedance element and the heat dissipated internally in the die can be improved or optimized. Additionally, by optimising between the heat dissipated externally of the die by the voltage dropping heat dissipating impedance element and that dissipated by the primary pass element, a further advantage is achieved when it is desired to provide the load in the form of an integrated circuit on the same die as the voltage regulating circuit or in the same package as the voltage regulating circuit, in that greater heat dissipation from the load can be tolerated.

Figure 2:
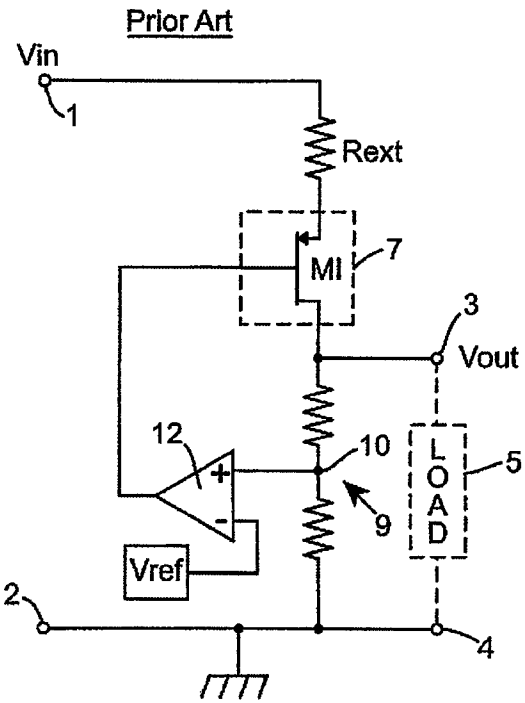
FIG. 2 is a circuit diagram of a linear voltage regulator also according to the prior art.
Figure 1:
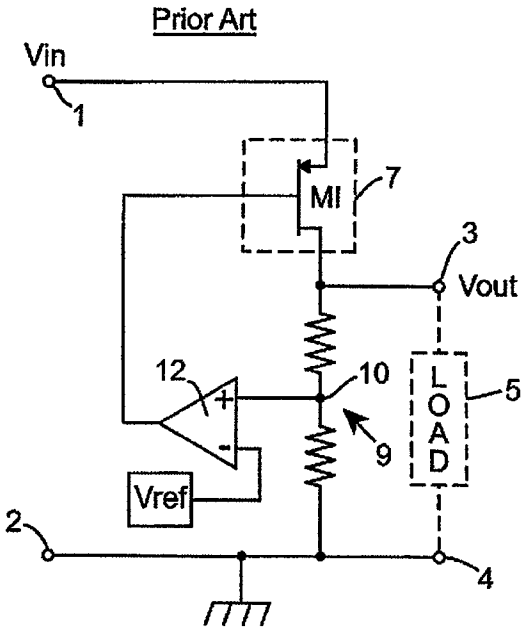
FIG. 1 is a circuit diagram of a linear voltage regulator according to the prior art.
Figure 3:
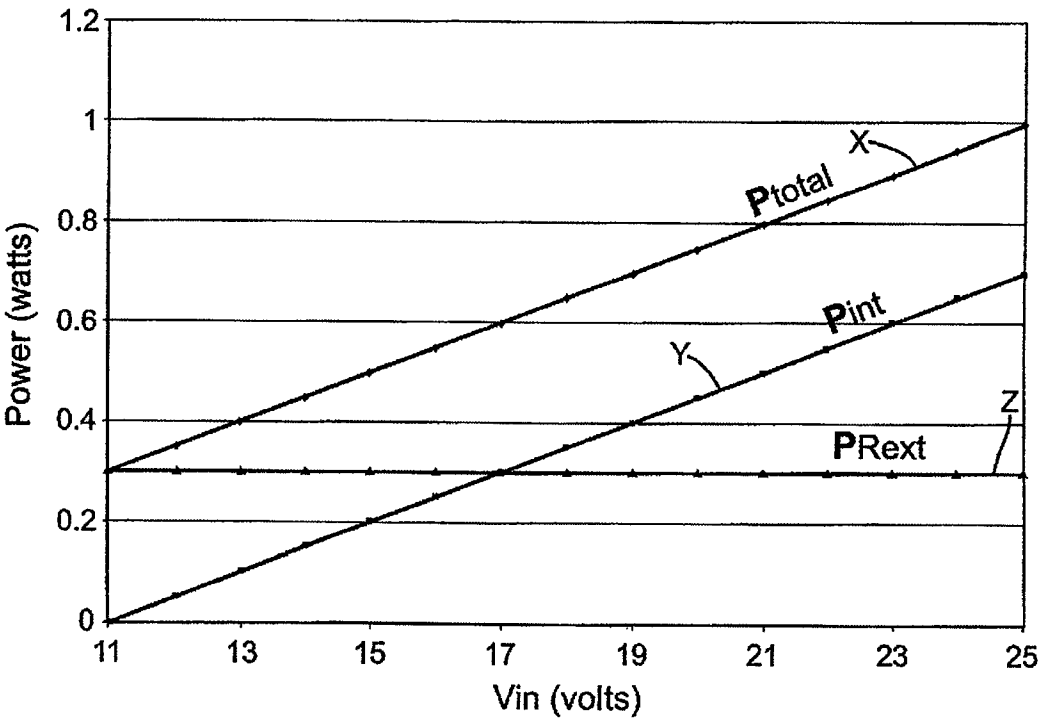
FIG. 3 illustrates a plot of power dissipated by the prior art linear voltage regulator of FIG. 2 against an unregulated DC input voltage applied to the linear voltage regulator.

A further advantage of the improved voltage regulation provided herein is that the heat dissipated by the voltage dropping heat dissipating impedance element increases as the voltage of the unregulated input voltage to the voltage regulating circuit increases due to the fact that the voltage across the voltage dropping heat dissipating impedance element increases as the voltage of the unregulated input voltage increases. A still further advantage is that the voltage regulating circuit can operate at a much lower voltage of the unregulated input voltage than voltage regulating circuits known heretofore, and in particular the prior art voltage regulator described with reference to FIG. 2, since the voltage dropped across the voltage dropping heat dissipating impedance element is progressively reduced towards zero volts as the unregulated input voltage approaches its minimum value, as the voltage of the unregulated input voltage progressively falls from the maximum value thereof.

By selecting the voltage at which the primary node is held, the ratio of the heat dissipated by the voltage dropping heat dissipating impedance element to the heat dissipated by the primary and secondary pass elements can be controlled, and the voltage of the unregulated input voltage at which the maximum value of the heat dissipated by the primary and secondary pass elements occurs can also be selected. Additionally, by varying the voltage on the primary node in response to the voltage value of the unregulated input voltage, the heat dissipated by the voltage dropping heat dissipating impedance element can be varied as the voltage value of the unregulated input voltage varies. A further advantage is achieved when the relationship between the heat dissipated by the voltage dropping heat dissipating impedance element and the unregulated input voltage is programmable, the relationship between the heat dissipated by the voltage dropping heat dissipating impedance element and the unregulated input voltage can be programmably altered so that the ratio of the heat dissipated by the voltage dropping heat dissipating impedance element to the heat dissipated by the primary and secondary pass elements can be optimized over the entire range of the unregulated input voltage.

The disclosure and its many advantages will be more clearly understood from the following description of some preferred embodiments thereof, which are given by way of non-limiting examples, with reference to the accompanying drawings. A skilled artisan will appreciate that not all of the advantages described above will be realized by each embodiment.

Figure 4:
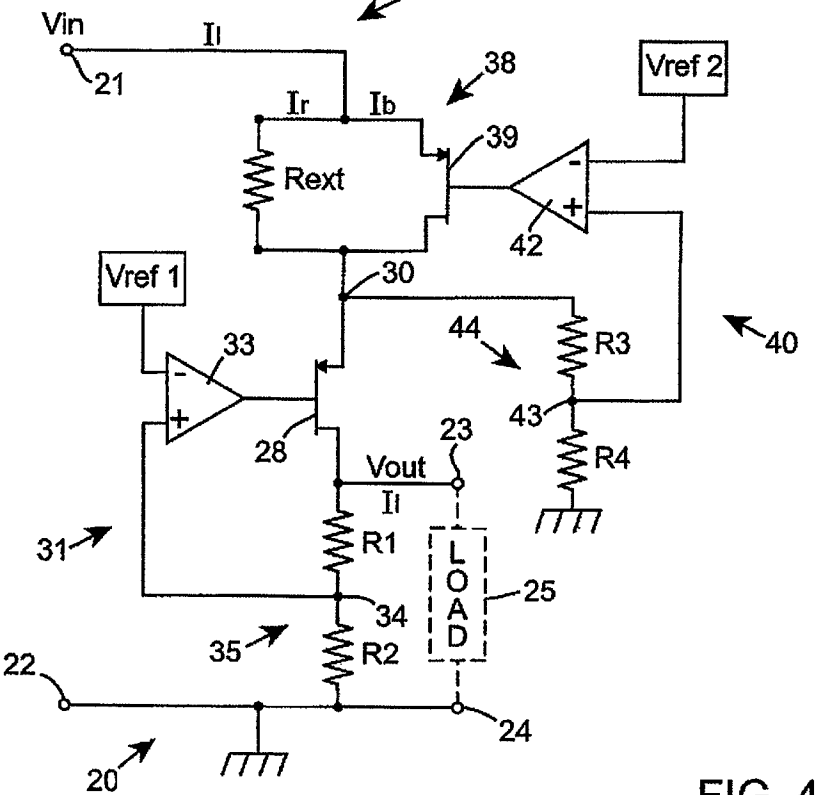
FIG. 4 is a circuit diagram of a voltage regulating circuit according to one embodiment.

Referring to FIG. 4 of the drawings, there is illustrated a voltage regulating circuit according to one embodiment, which in this case is a DC linear voltage regulating circuit indicated generally by the reference numeral 20, for producing a regulated DC output voltage from an unregulated DC input voltage supply. The voltage regulating circuit 20 comprises a pair of first and second input terminals 21 and 22 across which the unregulated DC input voltage is applied, and a pair of first and second output terminals 23 and 24 across which the regulated DC output voltage is produced, and across which a load 25 is applied. The second input terminal 22 and the second output terminal 24 are tied to a common voltage, which in this case is ground. Although chassis ground is shown in the figures, any suitable ground reference may be used.

A primary current path 27 extends between the first input terminal 21 and the first output terminal 23 through which the load current $I_l$ is drawn. A voltage dropping heat dissipating impedance element of fixed impedance, namely, an external resistor $R_{ext}$ and a primary pass element 28 of variable impedance are located in the primary current path 27. In this embodiment the primary pass element 28 comprises a first field effect transistor connected in series with the external resistor $R_{ext}$. The primary pass element 28 and the external resistor $R_{ext}$ define a primary node 30 in the primary current path 27, and the external resistor $R_{ext}$ produces a voltage drop between the input terminal 21 and the primary node 30.

A primary control circuit 31 controls the impedance of the primary pass element 28 in response to the output voltage produced across the output terminals 23 and 24 for maintaining the output voltage on the output terminals 23 and 24 at the regulated voltage value. The primary control circuit 31 comprises a first comparing means, namely, a first error amplifier 33 which compares a first voltage indicative of the voltage produced across the output terminals 23 and 24 with a second voltage, which in this case is provided by a first voltage reference $V_{ref1}$. The first error amplifier 33 produces a first control signal indicative of the difference between the first voltage indicative of the voltage produced across the output terminals 23 and 24 and the first voltage reference $V_{ref1}$. The first control signal is applied to the gate of the first field effect transistor of the primary pass element 28 for controlling the impedance of the first field effect transistor in order to maintain the voltage produced across the output terminals 23 and 24 at the regulated voltage value.

The first voltage which is indicative of the voltage produced across the output terminals 23 and 24 is derived from a first intermediate tap 34 of a first impedance-divider circuit provided by a first resistor-divider circuit 35 connected through an electronically conductive path between the output terminals 23 and 24. The first resistor-divider circuit 35 comprises two first resistors, namely, a resistor R1 and a resistor R2 between which the first intermediate tap 34 is defined. The first voltage from the first intermediate tap 34 is applied to one of the inverting and non-inverting inputs of the first error amplifier 33, and the first voltage reference $V_{ref1}$ is applied to the other of the inverting and non-inverting inputs of the first error amplifier 33 in order to produce a negative feedback loop with the primary pass element 28. In this case the first voltage from the first intermediate tap 34 is applied to the non-inverting input of the first error amplifier 33, and the first voltage reference $V_{ref1}$ is applied to the inverting input of the first error amplifier 33. The respective resistance values of the first resistors R1 and R2 are selected so that the division ratio of the first resistor-divider circuit 35 is such as to produce the first voltage on the first intermediate tap 34 to be of value approximately equal to the value of the first voltage reference $V_{ref1}$ when the output voltage produced across the output terminals 23 and 24 is at the regulated voltage value.

A bypass current path 38 parallel with the primary current path 27 bypasses the external resistor $R_{ext}$ and splits the load current $I_l$ so that some of the load current flows through the external resistor $R_{ext}$, namely, a current $I_r$, and the remainder of the load current flows through the bypass current path 38, namely, a current $I_b$. A secondary pass element 39 of variable impedance, which in this embodiment comprises a second field effect transistor is located in the bypass current path 38. A secondary control circuit 40 controls the impedance of the secondary pass element 39 in response to the voltage on the primary node 30 to in turn control the voltage on the primary node 30. In this embodiment the secondary control circuit 40, as will be described below, is adapted to maintain the voltage on the primary node 30 at a desired predefined voltage value for so long as the voltage of the unregulated input voltage applied across the input terminals 21 and 22 remains above the desired predefined voltage value at which the primary node 30 is to be maintained.

The secondary control circuit 40 comprises a second comparing means, namely, a second error amplifier 42 which compares a third voltage which is indicative of the voltage on the primary node 30 with a fourth voltage. In this embodiment the fourth voltage is provided by a second voltage reference $V_{ref2}$. The second error amplifier 42 produces a second control signal which is applied to the gate of the second field effect transistor for controlling the impedance of the secondary pass element 39 in order to maintain the voltage on the primary node 30 at the desired predefined voltage value. The third voltage which is indicative of the voltage on the primary node 30 is derived from a second intermediate tap 43 defined by a second impedance-divider circuit, namely, a second resistor-divider circuit 44 which is connected through an electrically conductive path between the primary node 30 and ground. The second resistor-divider circuit 44 comprises two second resistors R3 and R4 which define the second intermediate tap 43 therebetween.

The third voltage which is derived from the second intermediate tap 43 is applied to one of the inverting and non-inverting inputs of the second error amplifier 42, and the second voltage reference $V_{ref2}$ is applied to the other of the inverting and non-inverting inputs of the second error amplifier 42 in order to produce a negative feedback loop with the secondary pass element 39. In this embodiment the third voltage on the second intermediate tap 43 is applied to the non-inverting input of the second error amplifier 42, and the second voltage reference $V_{ref2}$ is applied to the inverting input of the second error amplifier 42. The second control signal produced by the second error amplifier 42 is indicative of the difference between the third voltage derived from the second intermediate tap 43 and the second voltage reference $V_{ref2}$. The respective resistance values of the second resistors R3 and R4 are selected so that the division ratio of the second resistor-divider circuit 44 is such as to produce the third voltage on the second intermediate tap 43 to be of value approximately equal to the value of the second voltage reference $V_{ref2}$ when the voltage on the primary node 30 is at the desired predefined voltage value.

In this embodiment the voltage regulating circuit 20 with the exception of the external resistor $R_{ext}$ is implemented as an integrated circuit on a die. The load 25 is also implemented as an integrated circuit on the same die. The external resistor $R_{ext}$ is selected to be 300 ohms and is located externally of the die, in order to dissipate heat externally of the die. The voltage regulating circuit 20 is configured to produce a regulated output voltage of 5 volts across the output terminals 23 and 24 with a maximum load current of 50 mA and is operable with an unregulated voltage supply, the voltage value of which varies between a minimum voltage of 11 volts and a maximum voltage of 25 volts. The secondary control circuit 40 is adapted to control the impedance of the second pass element 39 for maintaining the voltage on the primary node 30 at a desired predefined value of, for example, approximately 12 volts, for so long as the unregulated input voltage applied across the input terminals 21 and 22 remains sufficiently above 12 volts to allow the secondary pass element 39 to operate.

The load current $I_l$ is drawn from the first input terminal 21 through the primary current path 27 and through the first output terminal 23 to flow through the load 25. The load current $I_l$ is split by the bypass current path 38 so that some of the load current $I_l$, namely, the current $I_r$ passes through the external resistor $R_{ext}$, and the remainder of the load current $I_b$ passes through the bypass current path 38 and the secondary pass element 39. The proportion of the current $I_b$ passing through the bypass current path 38 is controlled by the secondary pass element 39 as the secondary pass element 39 is operated under the control of the secondary control circuit 40 in order to maintain the voltage on the primary node 30 at the desired predefined value of 12 volts. Thus, the value of the current $I_r$ passing through the external resistor $R_{ext}$ is equal to the difference between the load current $I_l$ and the current passing through the bypass current path 38, in other words, $$I_r = I_l - I_b$$

Accordingly, as the voltage of the unregulated input voltage which is applied across the input terminals 21 and 22 falls from the maximum value to the minimum value, the impedance of the secondary pass element 39 is progressively reduced in order to maintain the voltage on the primary node 30 at the desired predefined voltage value of 12 volts. This in turn progressively increases the value of the current $I_b$ flowing through the bypass current path 38, thereby reducing the value of the current $I_r$ flowing through the external resistor $R_{ext}$. Accordingly, the secondary control circuit 40 in conjunction with the secondary pass element 39 progressively reduces the voltage dropped across the external resistor $R_{ext}$ as the voltage of the unregulated input voltage applied to the input terminals 21 and 22 progressively falls from the maximum value. When the voltage of the unregulated input voltage applied to the input terminals 20 and 21 falls to a value just above the desired predefined value of 12 volts, at which the primary node 30 is to be maintained (allowing for the voltage drop required to operate the secondary pass element 39), virtually the entire load current $I_l$ passes through the bypass current path 38 with virtually no current passing through the external resistor $R_{ext}$. Thus, at this stage the voltage dropped across the external resistor $R_{ext}$ is approximately zero volts.

As the unregulated input voltage drops further below 12 volts, the secondary pass element 39 continues to conduct substantially the entire load current $I_l$, and thus, the external resistor $R_{ext}$ has little or no effect on the dropout voltage of the voltage regulating circuit 20. Thus, the voltage regulating circuit 20 can continue to produce the regulated output voltage across the output terminals 23 and 24 even if the unregulated input voltage which is applied to the input terminals 21 and 22 falls to a voltage just above 5 volts, which is sufficient to maintain the primary pass element 28 operational. Accordingly, as the unregulated input voltage which is applied to the input terminals 21 and 22 progressively falls from the maximum voltage thereof, the value of the voltage dropped across the external resistor $R_{ext}$ similarly progressively falls.

Conversely, as the voltage of the unregulated input voltage applied to the input terminals 21 and 22 progressively increases above the desired predefined voltage value of 12 volts at which the primary node 30 is maintained by the secondary control circuit 40, the voltage dropped across the external resistor $R_{ext}$ progressively increases, thereby progressively increasing the amount of power and in turn heat dissipated by the external resistor $R_{ext}$ as the voltage of the unregulated input voltage applied to the input terminals 21 and 22 progressively increases.

By maintaining the voltage on the primary node 30 at a desired predefined value, the maximum voltage which is dropped by the external resistor $R_{ext}$ can be controlled, and thus, the maximum heat dissipated by the external resistor $R_{ext}$ can be controlled. This, thus, allows the choice of external resistor to be optimised between the maximum voltage to be dropped by the external resistor $R_{ext}$ on the one hand, and the maximum power to be dissipated by the external resistor $R_{ext}$ on the other hand. As will be described in more detail below, by altering the value of the voltage at which the primary node 30 is maintained, the ratio of the maximum power, and in turn, the maximum heat dissipated by the external resistor $R_{ext}$ to the maximum power, and in turn the maximum heat dissipated by the primary and secondary pass elements 38 and 39 can be altered, and thus optimised.

Figure 5:
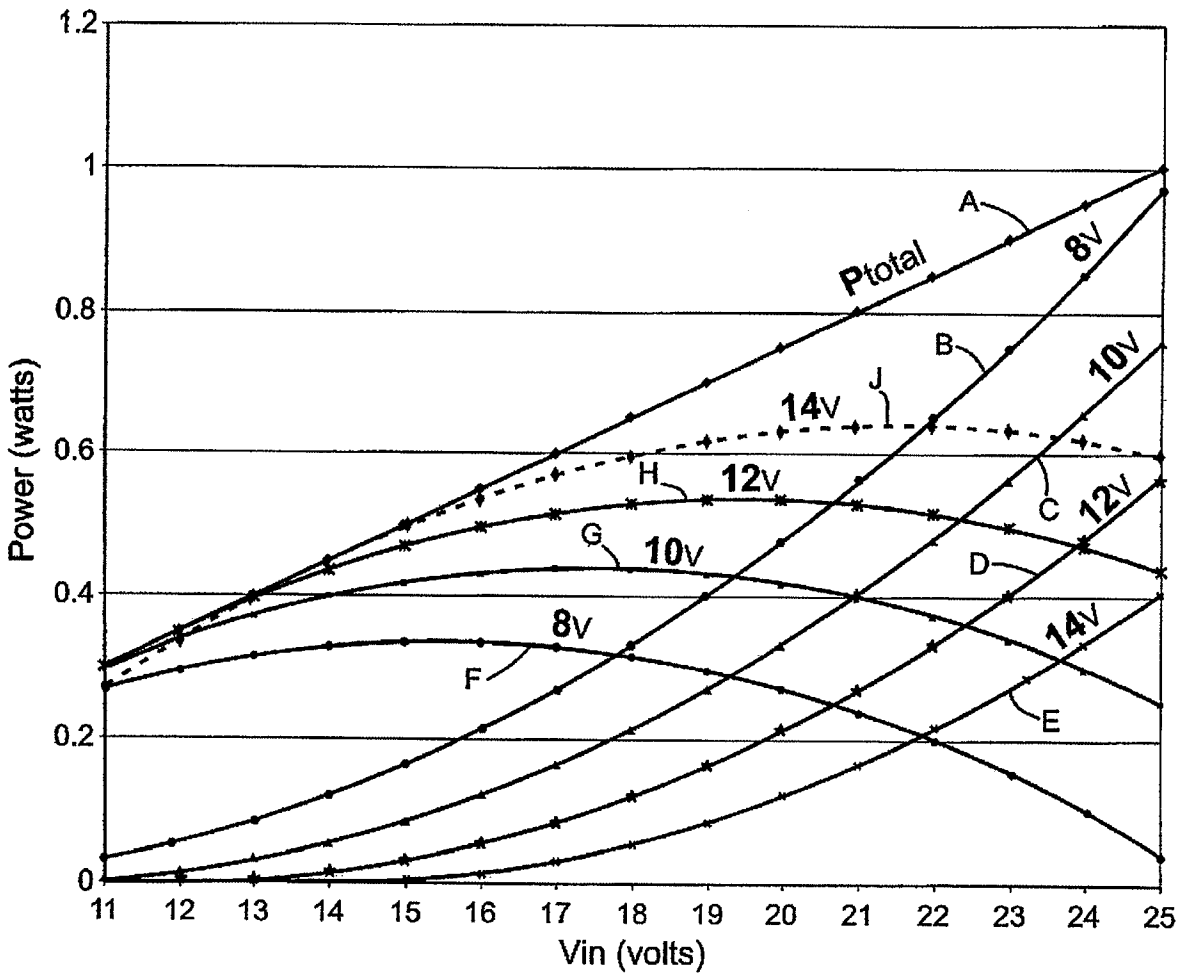
FIG. 5 illustrates a plot of power dissipation by the voltage regulating circuit of FIG. 4 against voltage of an unregulated DC input voltage supply applied to the voltage regulating circuit.

Referring now to FIG. 5, there is illustrated a series of graphs obtained from computer simulations of the voltage regulating circuit 20 as the value of the second voltage reference $V_{ref2}$ is varied for in turn varying the desired predefined voltage at which the primary node 30 is maintained. The graphs of FIG. 5 illustrate the relationship between the power dissipated externally by the external resistor $R_{ext}$ and internally within the voltage regulating circuit 20 by the primary and secondary pass elements 28 and 39 as the unregulated input voltage applied to the input terminals 21 and 22 varies for different voltage values of the desired predefined voltage on the primary node 30. In FIG. 5 the power in watts which is dissipated is plotted on the vertical Y-axis, and the voltage of the unregulated input voltage applied to the input terminals 21 and 22 is plotted in volts on the horizontal X-axis.

In the computer simulations the voltage on the primary node 30 was held at four different desired predefined values, namely, 8 volts, 10 volts, 12 volts and 14 volts as the unregulated input voltage was varied from 11 volts to 25 volts. As discussed above, the resistance value of the external resistor $R_{ext}$ is 300 ohms. Graph A represents the total power dissipated by the voltage regulating circuit 20 both externally by the external resistor $R_{ext}$ and internally in the voltage regulating circuit by the primary and secondary pass elements 28 and 39. Graphs B, C, D and E represent the power dissipated by the external resistor $R_{ext}$ when the primary node 30 was maintained at 8 volts, 10 volts, 12 volts and 14 volts, respectively. Graphs F, G, H and J represent the sum of the power dissipated by the primary and secondary pass elements 28 and 39 when the primary node 30 was maintained at 8 volts, 10 volts, 12 volts and 14 volts, respectively. Since all the power dissipated by the external resistor $R_{ext}$, and all the power dissipated by the primary and secondary pass elements 28 and 39 is dissipated as heat, the graphs of FIG. 5 illustrate the relationship between the heat dissipated by the external resistor $R_{ext}$ and the primary and secondary pass elements 28 and 39 as the unregulated input voltage varies for the different voltage values at which the primary node 30 is held.

As can be seen from graph A, for all four values of the voltage on the primary node 30, the total power dissipated by the external resistor $R_{ext}$ and the primary and secondary pass elements 28 and 39 increased substantially linearly from approximately 0.3 watts to 1 watt as the unregulated input voltage applied to the input terminals 21 and 22 increased from 11 volts to 25 volts. For all four values of the voltage at which the primary node 30 was maintained, the power dissipated by the external resistor $R_{ext}$ increased progressively as the unregulated input voltage applied to the input terminals 21 and 22 progressively increased from 11 volts to 25 volts, although, as can be seen from graphs B, C, D and E, the power dissipated across the external resistor $R_{ext}$ did not increase linearly, although it did progressively increase.

From graphs F, G, H and J for all four voltage values at which the primary node 30 was maintained, the relationship between the sum of the power dissipated by the primary and secondary pass elements 28 and 39 and the unregulated input voltage applied to the input terminals 21 and 22 between the maximum and minimum values thereof was a quadratic type relationship, whereby the sum of the power dissipated by the primary and secondary pass elements 28 and 39 initially increased to a maximum value, and then decreased. The sum of the power dissipated internally by the primary and secondary pass elements 28 and 39 in this embodiment when the primary node 30 is maintained at a predefined voltage is given approximately by the following equation:

$$P_{int} \approx -\frac{1}{R_{ext}} V_{in}^2 + \left(I_l + \frac{2V_{mid}}{R_{ext}}\right) V_{in} - \left(V_{out} \cdot I_l + \frac{V_{mid}^2}{R_{ext}}\right) \tag{1}$$

where $P_{int}$ is the sum of the power dissipated internally by the primary and secondary pass elements 28 and 39, $V_{in}$ is the voltage value of the unregulated input voltage applied to the input terminals 21 and 22, $V_{out}$ is the voltage value of the regulated output voltage produced across the output terminals 23 and 24, $V_{mid}$ is the voltage value at which the primary node 30 is maintained, $I_l$ is the value of the load current, and $R_{ext}$ is the resistance value of the external resistor.

The approximate value of the unregulated input voltage $V_{in}$ at which the sum of the power $P_{int}$ dissipated internally by the primary and secondary pass elements 28 and 39 is a maximum can be derived by obtaining the first derivative of equation (1), which produces a value for $V_{in}$ of the unregulated input voltage at which the power $P_{int}$ dissipated by the primary and secondary pass elements 28 and 39 is a maximum as the following equation:

$$V_{in} \text{ for } P_{int(max)} \approx \left(\frac{R_{ext} \cdot I_l}{2} + V_{mid}\right) \tag{2}$$

By substituting for $V_{in}$ in equation (1), the maximum power $P_{int(max)}$ dissipated by the primary and secondary pass elements 28 and 39 is given approximately by the following equation:

$$P_{int(max)} \approx I_l \cdot V_{mid} + \left(\frac{R_{ext} \cdot I_l^2}{4} - V_{out} \cdot I_l\right) \tag{3}$$

The value of the maximum power $P_{res(max)}$ dissipated by the external resistor $R_{ext}$ occurs at the maximum value of the unregulated input voltage and is approximately equal to the total power dissipated by the external resistor $R_{ext}$ less the sum of the power dissipated by the primary and secondary pass elements 28 and 39 when the unregulated input voltage is at its maximum value of 25 volts. Accordingly, the value of the maximum power $P_{res(max)}$ dissipated by the external resistor $R_{ext}$ is given approximately by the following equation:

$$P_{res(max)} \approx \frac{V_{mid}^2}{R_{ext}} - \frac{2V_{in(max)}}{R_{ext}} V_{mid} + \frac{V_{in(max)}^2}{R_{ext}} \tag{4}$$

where $V_{in(max)}$ is the maximum value of the unregulated input voltage which in the computer simulations is 25 volts.

Accordingly, by selecting the desired predefined voltage value at which the primary node 30 is maintained, the maximum power dissipated by the external resistor $R_{ext}$ and the maximum power dissipated by the primary and secondary pass elements 28 and 39 together can be optimised.

It should also be noted that the relationship between the power dissipated by the external resistor $R_{ext}$ and the unregulated input voltage is also a quadratic relationship as the unregulated input voltage varies between the maximum and minimum values thereof.

Returning now to FIG. 5, from graphs D and H when the primary node 30 is maintained at 12 volts, the power dissipated by the external resistor $R_{ext}$ reaches a maximum value of approximately 0.575 watts at the maximum value of the unregulated input voltage of 25 volts. The maximum power dissipated internally in the voltage regulating circuit by the primary and secondary pass elements 28 and 39 together reaches a maximum of approximately 0.55 watts when the voltage of the unregulated input voltage is at a value of approximately 19.5 volts. At that value of the unregulated input voltage the power dissipated by the external resistor $R_{ext}$ is approximately 0.18 watts. However, at that stage the total power dissipated by the voltage regulating circuit by the primary and secondary pass elements 28 and 39 and the external resistor $R_{ext}$ is approximately 0.72 watts. However, as the unregulated input voltage continues to increase above 19.5 volts, the power dissipated internally in the voltage regulating circuit 20 by the primary and secondary pass elements 28 and 39 commences to decrease until it falls to a value of approximately 0.45 watts when the unregulated input voltage reaches the maximum value of 25 volts, and the total power dissipated by the voltage regulating circuit 20 including the power dissipated by the primary and secondary pass elements 28 and 39 and the external resistor $R_{ext}$ reaches a maximum value of approximately 1 watt. At the maximum value of 25 volts of the unregulated input voltage, the power dissipated by the external resistor $R_{ext}$ is approximately 0.575 watts. Thus, by selecting the desired predefined voltage at which the primary node 30 is to be maintained at a value of approximately 12 volts, the power dissipated internally by the primary and secondary pass elements 28 and 39, respectively, together on the one hand and the power dissipated by the external resistor $R_{ext}$ on the other hand are relatively evenly balanced such that the maximum power dissipated by the external resistor $R_{ext}$ does not exceed approximately 0.575 watts and the maximum power dissipated by the primary and secondary pass elements 28 and 39 together does not exceed approximately 0.55 watts over the entire operating voltage range of 11 volts to 25 volts of the unregulated input voltage.

Accordingly, when the unregulated input voltage is at its maximum value of 25 volts, the total power dissipated by the voltage regulating circuit, including the power dissipated by the primary and secondary pass elements 28 and 39 and the external resistor $R_{ext}$ is at a maximum value of approximately 1 watt, and the power dissipated by the external resistor $R_{ext}$ is approximately 0.575 volts, and the sum of the power dissipated by the primary and secondary pass elements 28 and 39 is approximately 0.45 watts. As the unregulated input voltage commences to fall from the maximum value of 25 volts, the power dissipated by the external resistor $R_{ext}$ also commences to fall until the unregulated input voltage falls to approximately 12.75 volts, at which stage the power dissipated by the external resistor $R_{ext}$ approaches zero watts, and falls to approximately zero watts and remains at approximately zero watts as the unregulated input voltage continues to fall further. On the other hand, as the unregulated input voltage commences to fall from the maximum value of 25 volts, the sum of the power dissipated by the primary and secondary pass element 28 and 39 commences to rise until the unregulated input voltage falls to a value of approximately 19.5 volts, at which stage the sum of the power dissipated by the primary and secondary pass elements 28 and 39 reaches its maximum value of approximately 0.55 watts. Thereafter the sum of the power dissipated by the primary and secondary pass elements 28 and 39 falls as the unregulated input voltage falls.

As discussed above, as the unregulated input voltage falls from its maximum value of 25 volts, the power dissipated by the external resistor $R_{ext}$ continues to fall until the unregulated input voltage reaches a value of approximately 12.75 volts at which the power dissipated by the external resistor $R_{ext}$ approaches almost zero watts and the voltage across the external resistor $R_{ext}$ is approaching zero volts. As the unregulated input voltage continues to fall below 12.75 volts, and in turn approaches 12 volts, regulation of the voltage on the primary node 30 can be difficult to achieve, however, the secondary control circuit 40 continues to operate the secondary pass element 39 so that substantially the entire load current $I_l$ is conducted through the bypass circuit 38.

As the voltage of the unregulated input voltage continues to fall below 12 volts, the secondary control circuit 40 continues to operate the secondary pass element 39, so that substantially the entire load current $I_l$ is conducted through the bypass circuit 38. Accordingly, as the voltage of the unregulated input voltage falls below 12 volts, the voltage drop across the external resistor $R_{ext}$ remains at approximately zero volts, and thus, the primary control circuit 31 continues to regulate the voltage produced across the output terminals 23 and 24 at the regulated voltage value down to the minimum voltage value of 11 volts of the unregulated input voltage. Indeed, even if the unregulated input voltage were to fall further below the minimum voltage value of 11 volts, the primary control circuit 31 would continue to regulate the voltage developed across the output terminals 23 and 24 until the unregulated input voltage reached a value of 5 volts plus the additional voltage value required to operate the primary pass element 28. Since the voltage drop across the external resistor $R_{ext}$ remains at approximately zero volts for voltage values of the unregulated input voltage below 12 volts, the power dissipated by the external resistor $R_{ext}$ is substantially zero watts for voltage values of the unregulated input voltage below 12 volts.

A similar analysis to that described above can be carried out for the voltage regulating circuit 20 when the secondary control circuit 40 is configured to maintain the primary node 30 at predefined voltage values of 8 volts, 10 volts and 14 volts from the graphs B, C and E, respectively, and the graphs F, G and J, respectively. When the voltage on the primary node 30 is maintained at a predefined voltage of 8 volts, from graph F the maximum power dissipated by the primary and secondary pass elements 28 and 39 is approximately 0.33 watts and occurs when the unregulated input voltage is at approximately 15.5 volts. The maximum power dissipated by the external resistor $R_{ext}$ when the voltage on the primary node 30 is maintained at the predefined voltage 8 volts is approximately 0.96 watts, which occurs at the maximum value of 25 volts of the unregulated input voltage. This can be seen from graph B of FIG. 5. When the primary node 30 is maintained at a predefined voltage of 10 volts, from graph G the maximum power dissipated by the primary and secondary pass elements 28 and 39 is approximately 0.44 watts which occurs at a value of the unregulated input voltage of approximately 17.5 volts. From graph C when the primary node 30 is maintained at the predefined voltage of 10 volts, the maximum power dissipated by the external resistor $R_{ext}$ is approximately 0.75 watts, which occurs when the unregulated input voltage is at its maximum value of 25 volts. From graph J when the primary node 30 is maintained at a predefined voltage of 14 volts, the maximum power dissipated by the primary and secondary pass elements is approximately 0.64 watts, which occurs when the unregulated input voltage is at approximately 21.5 volts. Additionally, when the primary node 30 is maintained at the predefined voltage of 14 volts, from graph E the maximum power dissipated by the external resistor $R_{ext}$ is approximately 0.4 watts, which occurs when the unregulated input voltage is at its maximum value of approximately 25 volts.

Accordingly, from the graphs B, C, D and E, and the graphs F, G, H and J it can be seen that the balance between the maximum power dissipated by the external resistor $R_{ext}$ on the one hand and the maximum power dissipated by the primary and secondary pass elements 28 and 39 is optimised when the primary node 30 is maintained at the predefined voltage value of 12 volts. As the predefined voltage at which the primary node 30 is maintained is increased, the ratio of the maximum power dissipated by the external resistor on the one hand, to the maximum power dissipated by the primary and secondary pass elements 28 and 39 decreases with the optimum balance occurring when the primary node 30 is maintained at the predefined voltage of approximately 12 volts.

Figure 6:
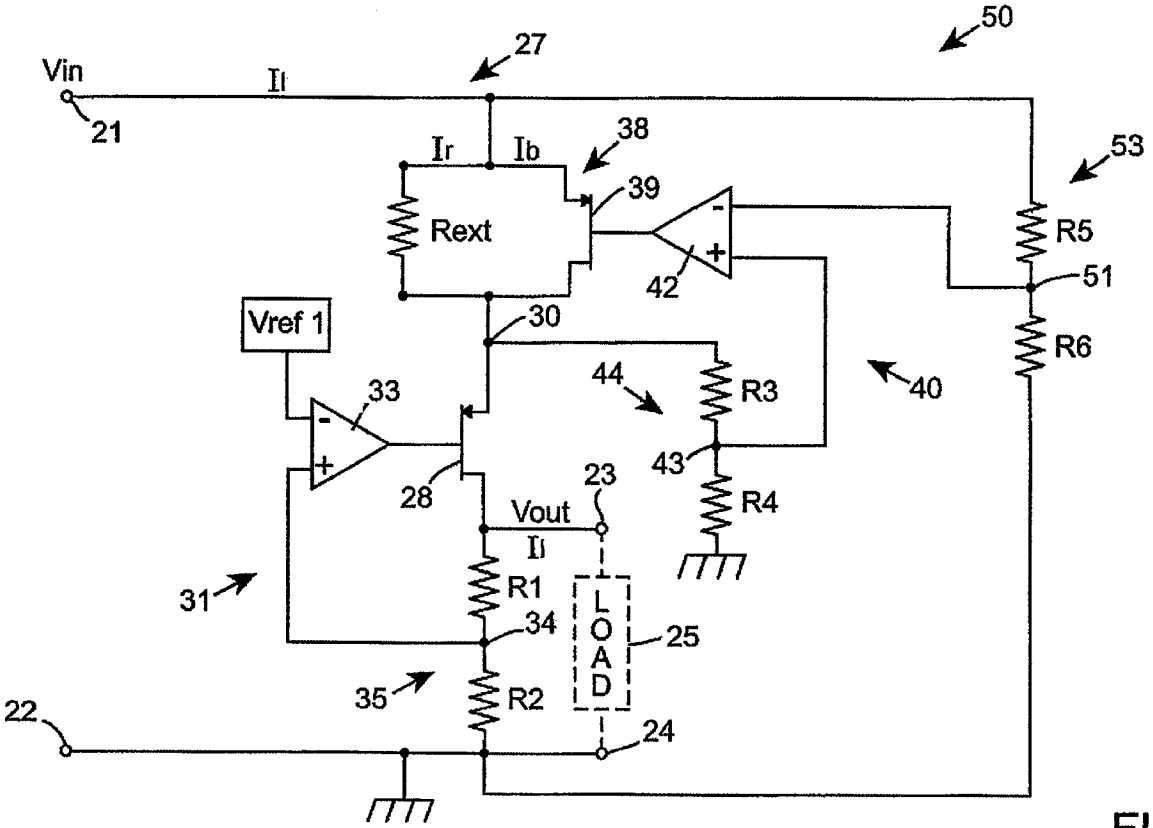
FIG. 6 is a circuit diagram of a voltage regulating circuit according to another embodiment of the invention.

Referring now to FIG. 6, there is illustrated a voltage regulating circuit according to another embodiment, indicated generally by the reference numeral 50. The voltage regulating circuit 50 is substantially similar to the voltage regulating circuit 20 described with reference to FIG. 4, and similar components are identified by the same reference numerals. The main difference between the voltage regulating circuit 50 and the voltage regulating circuit 20 is that in the voltage regulating circuit 50 the voltage on the primary node 30 is controlled in response to the voltage value of the unregulated input voltage applied across the first and second input terminals 21 and 22, and thus varies in response to the value of the unregulated input voltage. In this embodiment the second error amplifier 42 compares the third voltage on the second intermediate tap 43 of the second resistor-divider circuit 44 with a fourth voltage, which is indicative of the voltage value of the unregulated input voltage applied across the input terminals 21 and 22. The fourth voltage in this embodiment is derived from a third intermediate tap 51 of a third impedance-divider circuit, namely, a third resistor-divider circuit 53, which is connected through an electrically conductive path between the first and second input terminals 21 and 22. The third resistor-divider circuit 53 comprises third resistors R5 and R6 which define the third intermediate tap 51 therebetween.

Figure 7:
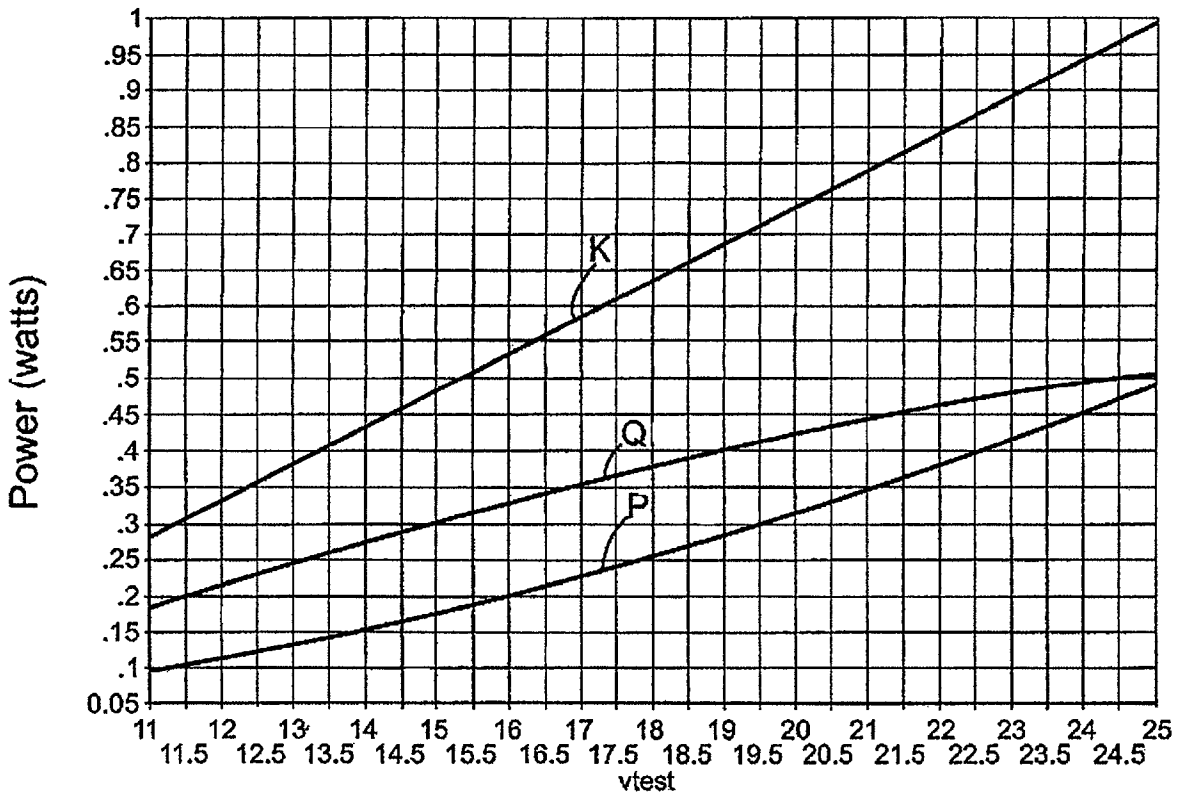
FIG. 7 illustrates a plot of power dissipation by the voltage regulating circuit of FIG. 6 against voltage of an unregulated DC input voltage supply applied to the voltage regulating circuit.

Referring now to FIG. 7, graphs of plots of power in watts dissipated by the external resistor $R_{ext}$ and by the primary and secondary pass elements 28 and 39 against voltage in volts of the unregulated input voltage which have been obtained from a computer simulation of the voltage regulating circuit 50 are illustrated. In FIG. 7 power in watts is plotted on the vertical Y-axis, while the unregulated input voltage in volts is plotted on the horizontal X-axis. In order to obtain the graphs of FIG. 7 the computer simulation was based on the voltage regulating circuit 50 being configured to produce a regulated output voltage of 5 volts across the first and second output terminals 23 and 24 with a maximum load current of 50 mA from an unregulated input voltage applied across the first and second input terminals 21 and 22 which varied from a minimum voltage value of 11 volts to a maximum voltage value of 25 volts. The external resistor $R_{ext}$ was selected to have a resistance value of 300 ohms. The division ratios of the second resistors R3 and R4 of the second resistor-divider circuit 44 and the division ratio of the third resistors R5 and R6 of the third resistor-divider circuit 53 were chosen so that the voltage value on the primary node 30 was maintained at a voltage of approximately one half the value of the unregulated input voltage applied across the first and second input terminals 21 and 22.

Graph K of FIG. 7 illustrates the total power dissipated by the external resistor $R_{ext}$ and by the primary and secondary pass elements 28 and 39 as the unregulated input voltage varies from the minimum value of 11 volts to the maximum value of 25 volts. As can be seen, the total power dissipated by the external resistor $R_{ext}$ and the primary and secondary pass elements 28 and 39 increases linearly from approximately 0275 watts to approximately 1 watt as the unregulated input voltage rises from 11 volts to 25 volts.

Graph P represents the power dissipated by the external resistor $R_{ext}$ as the voltage of the unregulated input voltage varies from the minimum voltage of 11 volts to the maximum voltage value of 25 volts, while graph Q represents the sum of the power dissipated by the primary and secondary pass elements 28 and 39 as the voltage value of the unregulated input voltage varies from the minimum value of 11 volts to the maximum value of 25 volts. As can be seen, the power dissipated by the external resistor $R_{ext}$ as represented by the graph P and the sum of the power dissipated by the primary and secondary pass elements 28 and 39 as represented by the graphs Q progressively increase as the unregulated input voltage increases from 11 volts to 25 volts, although the increase in the power dissipated by the external resistor $R_{ext}$ on the one hand and the sum of the power dissipated by the primary and secondary pass elements 28 and 39 on the other hand is not linear.

The rate of increase of the power dissipated by the external resistor $R_{ext}$ increases as the unregulated input voltage increases beyond approximately 19 volts, and conversely, the rate of increase of the sum of the power dissipated by the primary and secondary pass elements 28 and 39 decreases as the unregulated input voltage increases beyond approximately 19 volts. Thus, the power dissipated by the external resistor $R_{ext}$ increases from a value of just less than 0.1 watt as the unregulated input voltage increases from 11 volts to a value of just less than 0.5 watts when the unregulated input voltage has increased to 25 volts. The sum of the power dissipated by the primary and secondary pass elements 28 and 39 increases from a value of just above 0.175 watts when the unregulated input voltage is 11 volts to a value of just over 0.5 watts when the unregulated input voltage has reached 25 volts.

Accordingly, in the voltage regulating circuit 50 of this embodiment, as the voltage value of the unregulated input voltage increases, the power dissipated by the external resistor $R_{ext}$ on the one hand and the sum of the power dissipated by the primary and secondary pass elements 28 and 39 on the other hand both progressively increase, and conversely, as the voltage value of the unregulated input voltage falls from the maximum value of 25 volts to the minimum value of 11 volts, the power dissipated by the external resistor $R_{ext}$ on the one hand and the sum of the power dissipated by the primary and secondary pass elements 28 and 39 on the other hand progressively decrease. Additionally, in the voltage regulating circuit 50 according to this embodiment the ratio of the power dissipated by the external resistor $R_{ext}$ to the sum of the power dissipated by the primary and secondary pass elements 28 and 39 increases gradually from a ratio of approximately 1 to 1.8 when the unregulated input voltage value is 11 volts to just under 1 to 1 when the unregulated input voltage is at 25 volts.

However, in the voltage regulating circuit 50 according to this embodiment the dropout voltage, namely, the voltage value of the unregulated input voltage at which the voltage regulating circuit 50 can no longer produce the regulated output voltage of 5 volts, is higher than the dropout voltage down to which the voltage regulating circuit 20 can operate in order to produce the regulated output voltage of 5 volts. Since in this embodiment the division ratios of the second resistors R3 and R4 and the third resistors R5 and R6 are chosen so that the voltage on the primary node 30 is maintained at a voltage value of one half of the unregulated input voltage, if the unregulated input voltage falls below the minimum value of 11 volts, once the voltage value of the unregulated input voltage approaches 10 volts, the voltage on the primary node 30 will approach 5 volts, and thus, the primary control circuit 31 will no longer be able to maintain the regulated voltage of 5 volts across the first and second output terminals 23 and 24.

Since substantially all of the power dissipated by the external resistor $R_{ext}$ and by the primary and secondary pass elements 28 and 39 is dissipated as heat, the graphs of FIG. 7 illustrate the relationship between the heat dissipated by the external resistor $R_{ext}$ and the primary and secondary pass elements 28 and 39 as the unregulated input voltage varies.

It will of course be appreciated that the division ratios of the second and third resistors R3 and R4 and R5 and R6 of the second and third resistor-divider circuits 44 and 53, respectively, may be selected in order to maintain the voltage on the primary node 30 at a value proportional to the unregulated input voltage value other than one half of the voltage value of the unregulated input voltage.

Figure 8:
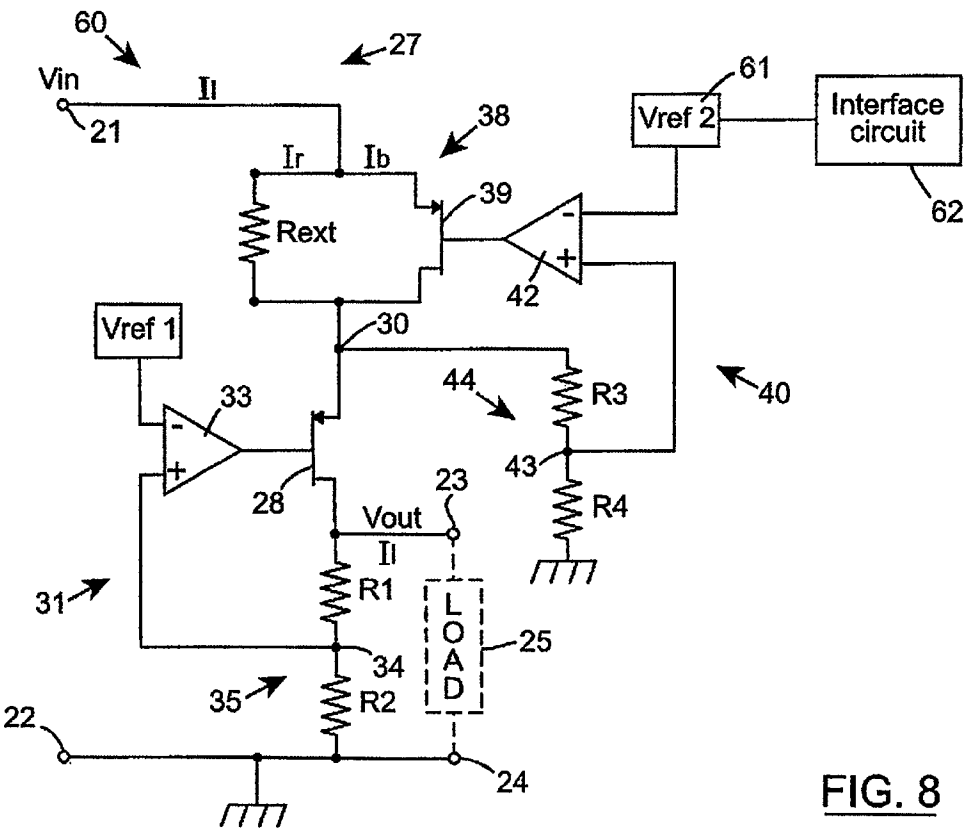
FIG. 8 is a circuit diagram of a voltage regulating circuit according to another embodiment.

Referring now to FIG. 8, there is illustrated a voltage regulating circuit according to another embodiment, indicated generally by the reference numeral 60. The voltage regulating circuit 60 is substantially similar to the voltage regulating circuit 20 described with reference to FIG. 4 and similar components are identified by the same reference numerals. One difference between the voltage regulating circuit 60 and the voltage regulating circuit 20 is that the desired predefined voltage value at which the primary node 30 is maintained is selectable. In this embodiment the second voltage reference $V_{ref2}$ is derived from a programmable voltage reference circuit 61 which produces a plurality of second voltage reference values. An interface circuit 62 facilitates selecting of a desired value of the second voltage reference $V_{ref2}$. Thus, by appropriately selecting the value of the second voltage reference $V_{ref2}$, the voltage value at which the primary node 30 is maintained is selectable. For example, the programmable voltage reference circuit may be programmed to produce selectable second voltage references of values of $V_{ref2}$ in order to maintain the primary node 30 at the predefined voltage values of 8 volts, 10 volts, 12 volts and 14 volts, which would be selectable through the interface circuit 62.

Figure 9:
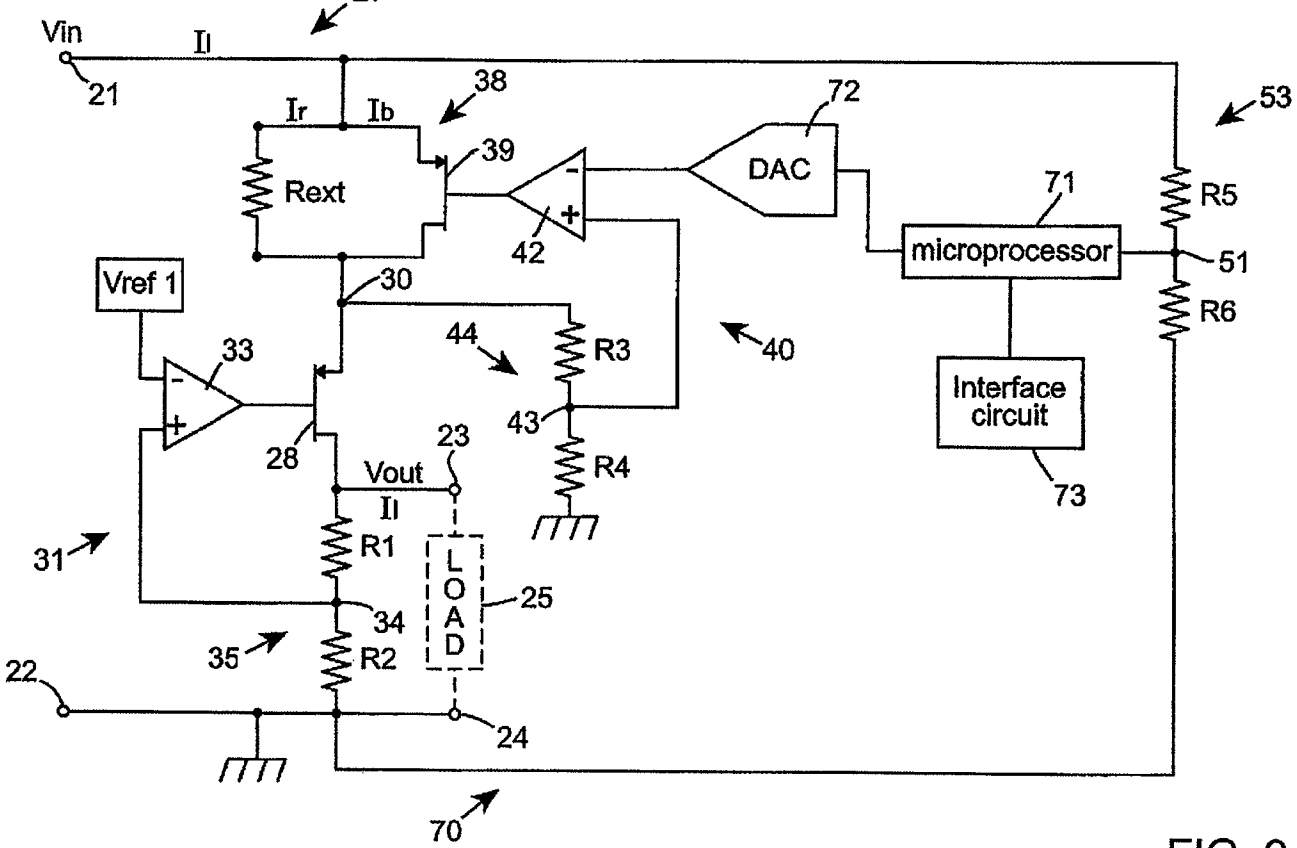
FIG. 9 is a circuit diagram of a voltage regulating circuit according to a further embodiment.

Referring now to FIG. 9, there is illustrated a voltage regulating circuit according to a further embodiment, indicated generally by the reference numeral 70. The voltage regulating circuit 70 is substantially similar to the voltage regulating circuit 50 which has been described with reference to FIG. 6, and similar components are identified by the same reference numerals. The main difference between the voltage regulating circuit 70 and the voltage regulating circuit 50 is that while the voltage on the primary node 30 is responsive to the voltage value of the unregulated input voltage, the relationship between the voltage on the primary node 30 and the voltage value of the unregulated input voltage is not a linear relationship. In this embodiment the voltage regulating circuit 70 comprises a microprocessor 71 and a digital-to-analogue converter 72. An interface circuit 73 is provided for interfacing with and programming the microprocessor 71.

The microprocessor 71 is programmable to produce digital voltage values in response to the fourth voltage on the third intermediate tap 51 of the third resistor-divider circuit 53 according to a programmable relationship. The digital-to-analogue converter 72 converts the digital voltage values produced by the microprocessor 71 in response to the fourth voltage on the third intermediate tap 51 to analogue voltage values which are applied to the inverting input of the second error amplifier 42. The second error amplifier 42 compares the third voltage on the second intermediate tap 43 with the voltage produced by the digital-to-analogue converter 72, and produces the second control signal which is applied to the secondary pass element 39, for in turn controlling the voltage on the primary node 30 in response to the unregulated input voltage in accordance with the programmable relationship programmed into the microprocessor 71.

The microprocessor 71 may, for example, be programmed to maintain the digital voltage value applied to the digital-to-analogue converter 72 at a first control voltage value while the unregulated input voltage is within a first range of voltage values, and at a second control voltage value when the unregulated input voltage is within a second range of voltage values, and at a third control voltage value when the unregulated input voltage is within a third range of voltage values, and so on, to achieve respective desired ratios of power dissipated by the external resistor $R_{ext}$ to the power dissipated by the primary and secondary pass elements for the respective different ranges of voltage values of the unregulated input voltage.

Alternatively, in the case where the voltage regulating circuit 70 is configured to produce a regulated output voltage of 5 volts from an unregulated input voltage which varies from a minimum voltage value of 11 volts to a maximum voltage value of 25 volts, the microprocessor 71 could be programmed to produce a first series of digital control voltage values while the unregulated input voltage is within the range of 11 volts to 15 volts, a second series of digital control voltage values while the unregulated input voltage is within a range of 15 volts to 20 volts, and a third series of digital control voltage values while the unregulated input voltage is within a range of 20 volts to 25 volts. The first series of digital control voltage values produced by the microprocessor 71 could be such as would vary the voltage progressively or in steps on the primary node 30 in response to the unregulated input voltage at a voltage which would maximise the ratio of the power dissipated by the external resistor $R_{ext}$ to the sum of the power dissipated by the primary and secondary pass elements 28 and 39, over the higher part of the range of 11 volts to 15 volts, and would reduce the voltage drop across the external resistor $R_{ext}$ to zero volts as the unregulated input voltage approached its minimum value of 11 volts. The third series of digital control voltage values produced by the microprocessor 71 could be such as would maintain the voltage on the primary node 30 at respective values which would limit the power dissipated by the external resistor $R_{ext}$ to a predefined upper limit, while the second series of digital control voltage values produced by the microprocessor 71 could be such as would maintain the voltage on the primary node 30 proportional to the unregulated input voltage which would maintain the ratio of the power dissipated by the external resistor $R_{ext}$ to the sum of the power dissipated by the primary and secondary pass elements 28 and 39 at a constant ratio value.

Needless to say, the microprocessor 71 may be programmed to maintain the voltage on the primary node 30 in any other suitable desired relationship with the unregulated input voltage.

It is envisaged that the microprocessor 71 in certain cases may be pre-programmed.

In the embodiments of the voltage regulating circuits 60 and 70, it is envisaged that the programmable voltage reference circuit 61 and the interface circuit 62 in the case of the voltage regulating circuit 60, and the microprocessor 71, and the interface circuit 73 of the voltage regulating circuit 70 may be implemented as an integrated circuit on the same die or package of the relevant voltage regulating circuit, although it will be appreciated in certain cases that the programmable voltage reference circuit 61 and the interface circuit 62 of the voltage regulating circuit 60, and the microprocessor 71 and the interface circuit 73 of the voltage regulating circuit 70 may be provided externally of the die or package of the relevant voltage regulating circuit.

Figure 10:
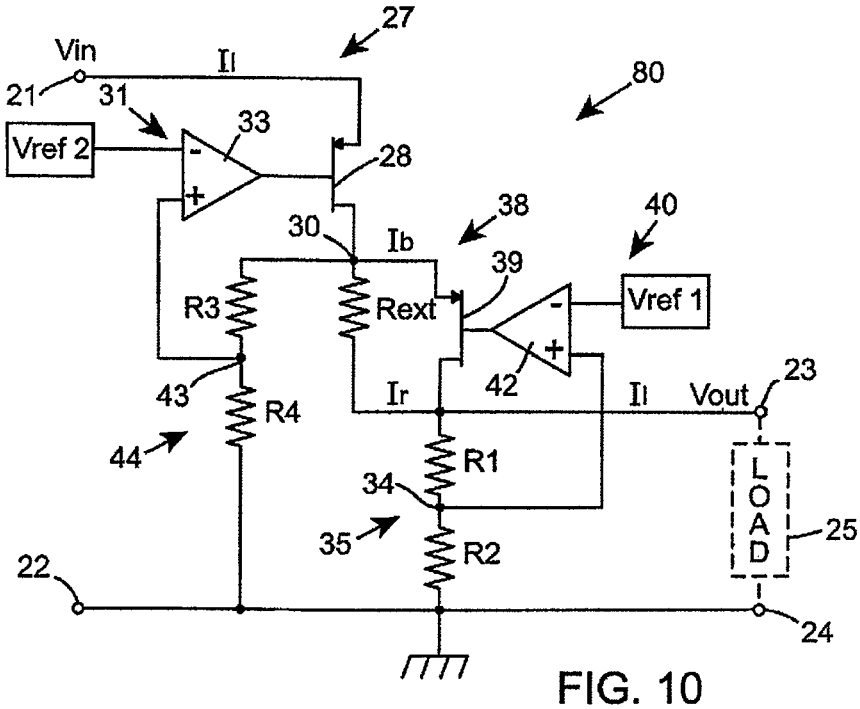
FIG. 10 is a circuit diagram of a voltage regulating circuit according to a still further embodiment.

Referring now to FIG. 10, there is illustrated a voltage regulating circuit according to another embodiment, indicated generally by the reference numeral 80. The voltage regulating circuit 80 is quite similar to the voltage regulating circuit 20 of FIG. 4, and similar components are identified by the same reference numerals. The main difference between the voltage regulating circuit 80 and the voltage regulating circuit 20 is that the external resistor $R_{ext}$ is located downstream of the primary pass element 28, in other words, the external resistor $R_{ext}$ is located between the primary pass element 28 and the first output terminal 23. However, the primary pass element 28 and the external resistor $R_{ext}$ define the primary node 30 in the primary current path 27. In this embodiment the primary control circuit 31 controls the impedance of the primary pass element 28 in response to the voltage on the primary node 30 in order to maintain the voltage on the primary node 30 at a desired predefined voltage value. The secondary control circuit 40 controls the impedance of the secondary pass element 39 in order to maintain the output voltage produced across the first and second output terminals 23 and 24 at the desired regulated voltage value.

In this embodiment the first error amplifier 33 of the primary control circuit 31 compares the third voltage which is indicative of the voltage on the primary node 30 and which is derived from the second intermediate tap 43 of the second resistor-divider circuit 44 with a fourth voltage, which in this embodiment is provided by a second voltage reference $V_{ref2}$. The second resistors R3 and R4 of the second resistor-divider circuit 44 are of value to produce a division ratio so that the voltage value of the third voltage on the second intermediate tap 43 of the second resistor-divider circuit 44 is of voltage value approximately equal to the voltage value of the second voltage reference $V_{ref2}$ when the voltage on the primary node 30 is at the desired predefined voltage value. The first control signal produced by the first error amplifier 33 controls the impedance of the primary pass element 28 for maintaining the voltage on the primary node 30 at the predefined desired voltage value. The second error amplifier 42 of the secondary control circuit 40 compares the first voltage which is indicative of the output voltage produced across the output terminals 23 and 24, and which is derived from the first intermediate tap 34 of the first resistor-divider circuit 35 with a second voltage, which in this embodiment is provided by a first voltage reference $V_{ref1}$. The first resistors R1 and R2 are selected to produce a division ratio of the first resistor-divider circuit 35 such that the first voltage appearing on the first intermediate tap 34 is approximately equal to the value of the first voltage reference $V_{ref1}$ when the output voltage produced across the output terminals 23 and 24 is at the regulated voltage value. The second control signal produced by the second error amplifier 42 is applied to the secondary pass element 39 for controlling the impedance of the secondary pass element 39 for maintaining the output voltage produced across the output terminals 23 and 24 at the regulated voltage value.

Accordingly, in this embodiment the voltage across the external resistor $R_{ext}$ is held substantially constant until the unregulated input voltage applied across the input terminals 21 and 22 falls to a value approaching the predefined voltage at which the primary control circuit 31 can no longer maintain the voltage on the primary node 30 at the predefined voltage value. Thereafter as the unregulated input voltage continues to fall, the voltage on the primary node 30 commences to fall, and thus, the voltage across the external resistor $R_{ext}$ correspondingly falls. In this embodiment as the unregulated input voltage continues to fall further, the voltage across the external resistor $R_{ext}$ likewise continues to fall until the unregulated input voltage falls to a value at which the secondary control circuit 40 can no longer maintain the output voltage produced across the output terminals 23 and 24 at the regulated voltage value, in other words, until the unregulated input voltage has reached the drop-out voltage.

Accordingly, in this embodiment the heat dissipated across the external resistor $R_{ext}$ remains constant during periods while the unregulated input voltage is of value above the value at which the primary control circuit 31 can maintain the voltage on the primary node 30 at the desired predefined voltage, and thereafter the power dissipated by the external resistor falls as the unregulated input voltage falls below the voltage required for the primary control circuit 31 to maintain the voltage on the primary node 30 at the desired predefined voltage.

Figure 11:
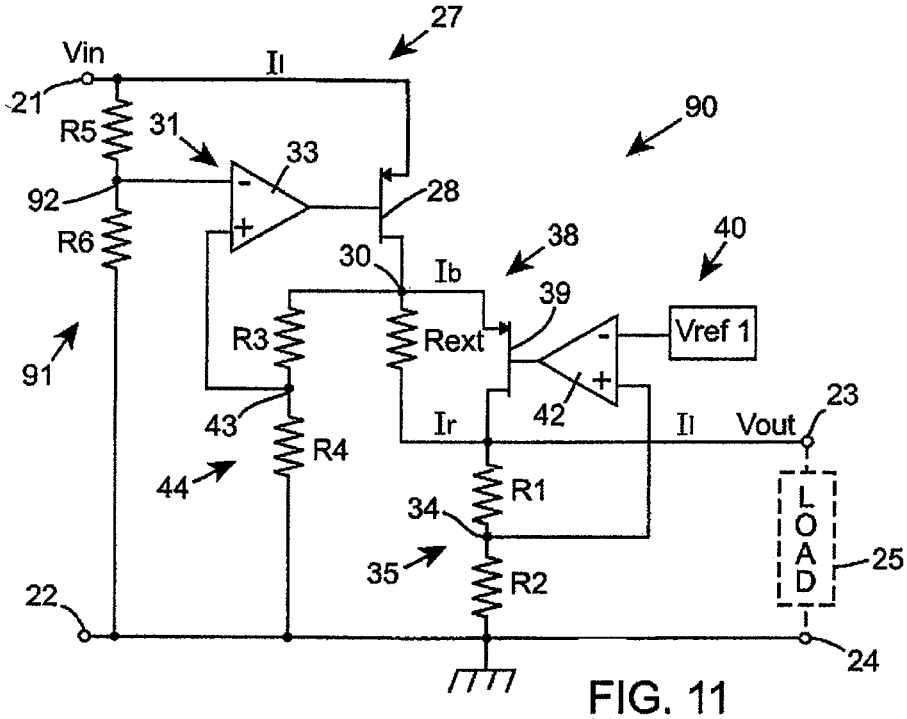
FIG. 11 is a circuit diagram of a voltage regulating circuit according to another embodiment.

Referring now to FIG. 11 there is illustrated a voltage regulating circuit according to a still further embodiment indicated generally by the reference numeral 90. The voltage regulating circuit 90 is substantially similar to the voltage regulating circuit 80 of FIG. 10, and similar components are identified by the same reference numerals. The only difference between the voltage regulating circuit 90 and the voltage regulating circuit 80 is that instead of the third voltage on the second intermediate tap 43 of the second resistor-divider circuit 44 being compared with a fourth voltage provided by a second voltage reference, the third voltage produced on the second intermediate tap 43 of the second resistor-divider circuit 44 is compared by the first error amplifier 33 with a fourth voltage which in this case is indicative of the unregulated input voltage. The fourth voltage which is indicative of the unregulated input voltage is derived from a third resistor-divider circuit 91 which is connected through a conductive path between the first and second input terminals 21 and 22. The third resistor-divider circuit 91 comprises third resistors R5 and R6 which define a third intermediate tap 92 on which fourth voltage indicative of the unregulated input voltage is produced. The resistance values of the second resistors R3 and R4 of the second resistor-divider circuit 44 and the resistance values of the third resistors R5 and R6 of the third resistor-divider circuit 91 are selected so that the respective division ratios are such that the voltage on the primary node 30 is maintained at a voltage which is approximately 0.6 times the value of the unregulated input voltage.

A computer simulation of the voltage regulating circuit 90 of FIG. 11 was carried out. In the computer simulation the voltage regulating circuit 90 was configured to produce a regulated output voltage across the output terminals 23 and 24 of 5 volts from an unregulated input voltage which varies from a minimum value of 11 volts to a maximum of 20.5 volts. The external resistor $R_{ext}$ was selected to have a resistance value of 200 ohms. The second and third resistors R1, R2, R5 and R6 were selected to produce division ratios in the second and third resistor-divider circuits 44 and 91 so that the voltage on the primary node 30 was held at a voltage approximately 0.6 times the value of the unregulated input voltage as the unregulated input voltage varied.

Figure 12:
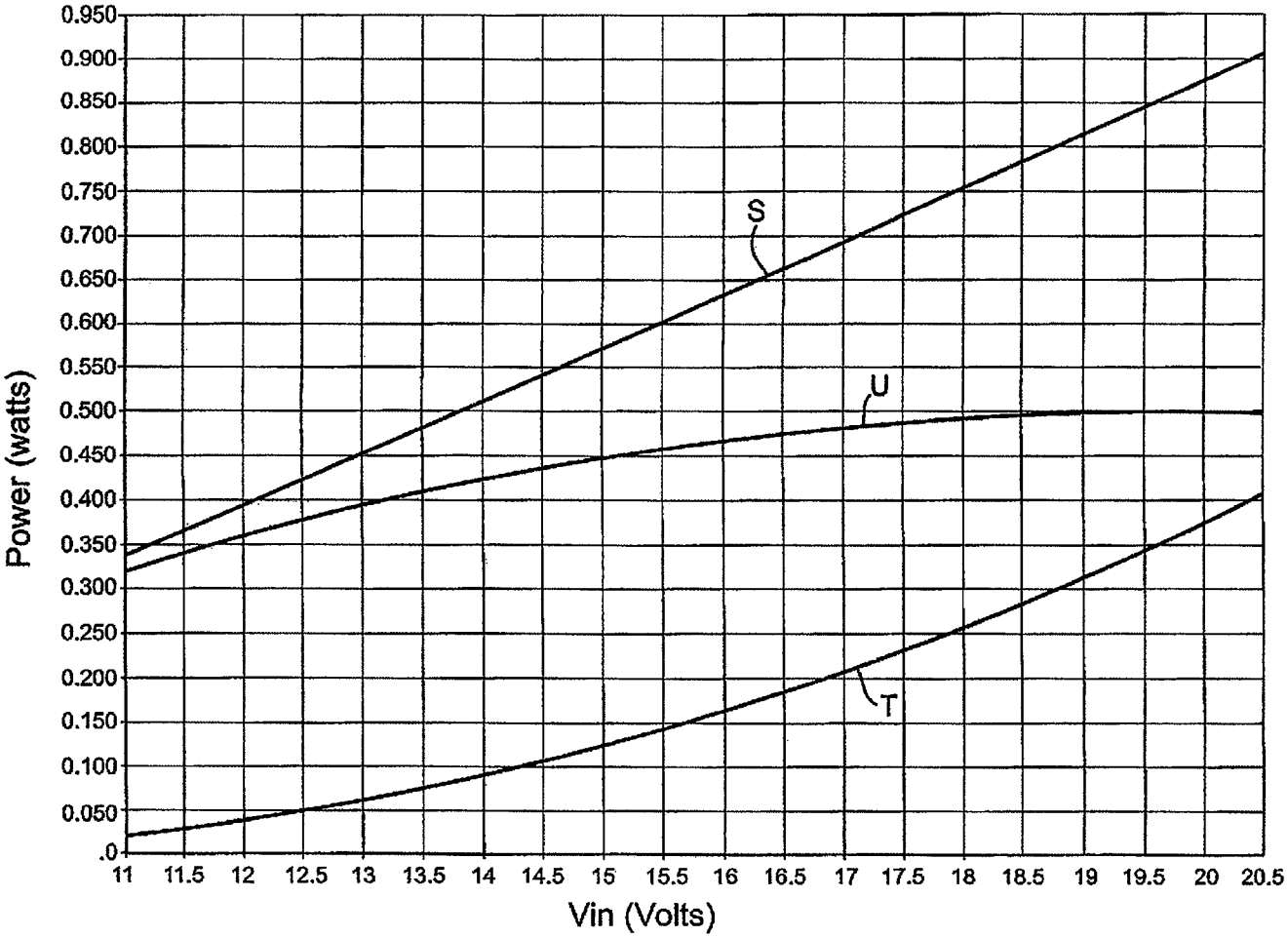
FIG. 12 illustrates a plot of the power dissipated by the voltage regulating circuit of FIG. 11 against voltage of an unregulated DC input voltage supply applied to the voltage regulating circuit.

FIG. 12 illustrates graphs produced by the computer simulation of the voltage regulating circuit 90, which represent the power dissipated by the voltage regulating circuit 90 plotted against the unregulated input voltage. Power in watts in plotted on the vertical Y axis, and the unregulated input voltage in volts is plotted on the horizontal X axis. Graph S of FIG. 12 represents the total power dissipated by the external resistor $R_{ext}$ and the primary and secondary pass elements 28 and 39 as the unregulated input voltage varies from the minimum voltage value of 11 volts to the maximum voltage value of 20.5 volts. Graph T of FIG. 12 represents the power dissipated by the external resistor $R_{ext}$ as the unregulated voltage varies from the minimum voltage value of 11 volts to the maximum voltage value of 20.5 volts. Graph U of FIG. 12 represents the power dissipated by the primary and secondary pass elements 28 and 29 as the unregulated input voltage varies from the minimum voltage value of 11 volts to the maximum voltage of 20.5 volts.

As can be seen the total power and in turn the heat dissipated by the external resistor $R_{ext}$ and the primary and secondary pass elements 28 and 39 rises linearly from a value of approximately 0.340 watts when the unregulated input voltage is at its minimum value of 11 volts to a maximum value of approximately 0.900 watts when the unregulated input voltage is at its maximum value of 20.5 volts. The power, and in turn the heat dissipated by the external resistor $R_{ext}$ progressively increases from a value of approximately 0.020 watts when the unregulated input voltage is at its minimum value of 11 volts to a maximum value of approximately 0.410 watts when the unregulated voltage has increased to its maximum value of 20.5 volts. Although the power dissipated by the external resistor $R_{ext}$ progressively increases as the voltage of the unregulated input voltage increases, the relationship between the power dissipated by the external resistor and the unregulated input voltage is not linear. From graph U the power and in turn the heat dissipated by the primary and secondary pass elements 28 and 39 increases from a value of approximately 0.320 watts to approximately 0.500 watts as the unregulated input voltage rises from the minimum value of 11 volts to the maximum value of 20.5 volts. In this embodiment the power dissipated by the primary and secondary pass elements 28 and 39 progressively rises as the unregulated input voltage rises from the minimum value of 11 volts until the unregulated input voltage reaches approximately 18.5 volts, at which stage the power dissipated by the primary and secondary pass elements 28 and 39 remains substantially constant at approximately 0.500 watts while the unregulated input voltage varies between 18.5 volts and 20.5 volts, during which time the power dissipated externally by the external resistor $R_{ext}$ continues to rise. Although the power dissipated by the primary and secondary pass elements 28 and 39 rises progressively as the unregulated input voltage rises from 11 volts to 18.5 volts, the relationship between the power dissipated by the primary and secondary pass elements 28 and 39 and the unregulated input voltage between the minimum value of 11 volts and the voltage value of 18.5 volts is not linear.

While the second error amplifier 42 of the voltage regulating circuit 20 described with reference to FIG. 4 has been described as comparing the voltage indicative of the voltage on the primary node 30 with a second voltage reference, it is envisaged in certain cases that the second error amplifier 42 could compare the third voltage indicative of the voltage on the primary node 30 with the first voltage reference, and in which case, the division ratio of the second resistors R3 and R4 would be appropriately altered so that the voltage value appearing on the second intermediate tap 43 would be of value approximately equal to the voltage value of the first voltage reference when the voltage on the primary node 30 is at the desired predefined value.

While the voltage regulating circuits have been described as being adapted to produce a 5 volt regulated output voltage from an unregulated voltage supply which varies between 11 volts and 25 volts, it will be readily apparent to those skilled in the art that the voltage regulating circuits according to certain embodiments may be configured for producing a regulated output voltage of value other than 5 volts, and likewise, the voltage regulating circuits may be configured to operate with unregulated voltage supplies of other voltage ranges besides a voltage range of 11 volts to 25 volts.

While the voltage regulating circuits according to certain embodiments have been described as comprising primary and secondary pass elements provided by first and second field effect transistors, respectively, any suitable pass elements may be provided.

It will be appreciated that while the external resistors $R_{ext}$ of the voltage regulating circuits which have been described with reference to the drawings have been described as being of specific resistance values, the external resistors $R_{ext}$ may be of any suitable value, and in general, the resistance value of the external resistor will be determined by the voltage range over which the unregulated input voltage varies, and also will be selected depending on the ratio of the power to be dissipated by the external resistor to the sum of the power to be dissipated by the primary and secondary pass elements.

While the voltages indicative of the voltage on the primary node and the output voltage produced across the output terminals have been derived from resistor-divider circuits, the voltages indicative of the voltage on the primary node and the output voltage produced across the output terminals may be derived by any other suitable means which would produce a voltage indicative of the voltage on the primary node and a voltage indicative of the voltage produced across the output terminals. Additionally, it will be appreciated that where the voltages indicative of the voltage on the primary node and the output voltage produced across the output terminals have been derived from the respective resistor-divider circuits, which have been connected to ground voltage, the resistor-divider circuits which produce the voltage indicative of the primary node may be coupled between the primary node and any other suitable constant known voltage, and in the case of the voltage indicative of the output voltage produced across the output terminal, the resistor-divider circuit may be connected between the first output terminal and any other suitable constant known voltage.

The voltage regulating circuits according to certain embodiments which have been described with reference to FIGS. 4 to 12 are implemented as integrated circuits, and may be implemented on a single die or on a number of dies. However, the single die or the dies on which the voltage regulating circuit is formed are encapsulated in a package, and the external resistor $R_{ext}$ in all cases is located externally of the package for dissipating heat externally of the package. Additionally, the load may be implemented on the same die or dies on which the voltage regulating circuit is implemented, or may be implemented on a separate die encapsulated in the same package as the die or dies on which the voltage regulating circuit is implemented, and in which case, the external resistor $R_{ext}$ would be located externally of the package for dissipating heat externally of the package. It will of course be appreciated that the load may be provided completely externally of the die or dies on which the voltage regulating circuit is implemented, and also, the load may be located entirely externally of the package in which the voltage regulating circuit is implemented.

While the voltage regulating circuit has been described as being implemented as an integrated circuit, it is envisaged in certain cases that the voltage regulating circuit may be implemented in a manner other than as an integrated circuit.

What is claimed is:

1. A DC voltage regulating circuit configured to receive an unregulated DC input voltage, and to provide an output voltage to a load, the output voltage being a regulated DC voltage, and the voltage regulating circuit comprising:

a primary pass element of variable impedance;

a voltage dropping heat dissipating impedance element in series with the primary pass element, wherein a primary node is disposed between the primary pass element and the voltage dropping heat dissipating impedance element;

a secondary pass element of variable impedance, wherein the secondary pass element is in parallel with the voltage dropping heat dissipating impedance element;

a primary control circuit configured to control the variable impedance of the primary pass element responsive to one of the output voltage or the voltage on the primary node; and a secondary control circuit configured to control the variable impedance of the secondary pass element responsive to the other one of the output voltage or the voltage on the primary node;

wherein the primary pass element, the secondary pass element, the primary control circuit, and the secondary control circuit are included on one or more dies; and wherein the voltage dropping heat dissipating impedance element is external to the one or more dies.

2. A voltage regulating circuit as claimed in claim 1 in which the voltage on the primary node is controlled so that the relationship between heat dissipated by the voltage dropping heat dissipating impedance element and the unregulated DC input voltage is a quadratic relationship.

3. A voltage regulating circuit as claimed in claim 1 in which the voltage on the primary node is controlled so that the relationship between heat dissipated by the primary and secondary pass elements and the unregulated DC input voltage is a quadratic relationship.

4. A voltage regulating circuit as claimed in claim 1 in which the one or more dies are located in a package, and the voltage dropping heat dissipating impedance element is located externally of the package.

5. A voltage regulating circuit as claimed in claim 1, further comprising a load formed on the one or more dies, the load being supplied with the regulated output voltage from the voltage regulating circuit.

6. A voltage regulating circuit as claimed in claim 1, wherein the voltage regulating circuit is formed on a single die with the exception of the voltage dropping heat dissipating impedance element, and wherein the voltage dropping heat dissipating impedance element is located externally of the single die.

7. A voltage regulating circuit as claimed in claim 1 in which the voltage dropping heat dissipating impedance element is a resistor.

8. A voltage regulating circuit as claimed in claim 1 in which:

the primary control circuit is configured to control the variable impedance of the primary pass element responsive to the output voltage to maintain the output voltage at a regulated voltage value, and the secondary control circuit is configured to control the variable impedance of the secondary pass element responsive to the voltage on the primary node to control the voltage on the primary node.

9. A voltage regulating circuit as claimed in claim 8 in which the voltage dropping heat dissipating impedance element is between a first input terminal of the voltage regulating circuit and the primary pass element.

10. A voltage regulating circuit as claimed in claim 8 in which the primary control circuit comprises a first compare circuit configured to compare a first voltage indicative of the output voltage with a second voltage, and to produce a first control signal indicative of the difference between the first voltage and the second voltage.

11. A voltage regulating circuit as claimed in claim 10 in which the second voltage is derived from a first voltage reference.

12. A voltage regulating circuit as claimed in claim 10 in which the first control signal is applied to the primary pass element, and the impedance of the primary pass element is responsive to the first control signal.

13. A voltage regulating circuit as claimed in claim 10 in which the primary pass element comprises a first transistor configured to vary its impedance in series with the voltage dropping heat dissipating impedance element responsive to the first control signal.

14. A voltage regulating circuit as claimed in claim 10 in which the first voltage indicative of the output voltage is derived from a first intermediate tap defined by a first impedance-divider circuit connected across output terminals of the voltage regulator circuit.

15. A voltage regulating circuit as claimed in claim 14 in which the first impedance-divider circuit comprises at least two first electrically resistive elements between which the first intermediate tap is defined.

16. A voltage regulating circuit as claimed in claim 10 in which the first compare circuit comprises a first error amplifier configured to produce the first control signal, the first voltage indicative of the output voltage being applied to one of an inverting input and a non-inverting input of the first error amplifier, and the second voltage being applied to the other of the inverting input and the non-inverting input of the first error amplifier, to produce a negative feedback loop with the primary pass element.

17. A voltage regulating circuit as claimed in claim 16 in which the secondary pass element comprises a second transistor configured to vary its impedance is parallel with the voltage dropping heat dissipating impedance element responsive to the second control signal.

18. A voltage regulating circuit as claimed in claim 8 in which the secondary control circuit comprises a second compare circuit configured to compare a third voltage indicative of the voltage on the primary node with a fourth voltage, and to produce a second control signal indicative of the difference between the third voltage and the fourth voltage.

19. A voltage regulating circuit as claimed in claim 18 in which the fourth voltage is derived from a voltage reference.

20. A voltage regulating circuit as claimed in claim 18 in which the fourth voltage is derived from a variable voltage.

21. A voltage regulating circuit as claimed in claim 18 in which the fourth voltage is derived from a variable voltage reference.

22. A voltage regulating circuit as claimed in claim 18 in which the fourth voltage is programmable.

23. A voltage regulating circuit as claimed in claim 18 in which the fourth voltage is derived from the unregulated DC input voltage.

24. A voltage regulating circuit as claimed in claim 18 in which the fourth voltage is selectable.

25. A voltage regulating circuit as claimed in claim 18 in which the second control signal is applied to the secondary pass element, and the impedance of the secondary pass element is responsive to the second control signal.

26. A voltage regulating circuit as claimed in claim 25 in which the second compare circuit comprises a second error amplifier configured to produce the second control signal, the third voltage being applied to one of an inverting input and a non-inverting input of the second error amplifier, and the fourth voltage being applied to the other of the inverting input and the non-inverting input of the error amplifier to produce a negative feedback loop with the secondary pass element.

27. A voltage regulating circuit as claimed in claim 18 in which the third voltage is derived from a second intermediate tap defined by a second impedance-divider circuit connected between the primary node and a ground potential.

28. A voltage regulating circuit as claimed in claim 27 in which the second impedance-divider circuit comprises at least two second electrically resistive elements defining the second intermediate tap therebetween.

29. A voltage regulating circuit as claimed in claim 1 in which:

the primary control circuit is configured to control the variable impedance of the primary pass element responsive to the voltage on the primary node control the voltage on the primary node, and the secondary control circuit is configured to control the variable impedance of the secondary pass element responsive to the output voltage to maintain the output voltage at a regulated voltage value.

30. A voltage regulating circuit as claimed in claim 29 in which the voltage dropping heat dissipating impedance element is located between the primary node and a first output terminal of the voltage regulating circuit.

31. A voltage regulating circuit as claimed in claim 29 in which the primary control circuit comprises a first compare circuit configured to compare a third voltage indicative of the voltage on the primary node with a fourth voltage, and to produce a first control signal indicative of the difference between the third voltage and the fourth voltage.

32. A voltage regulating circuit as claimed in claim 31 in which the first control signal is applied to the primary pass element, and the impedance of the primary pass element is responsive to the first control signal.

33. A voltage regulating circuit as claimed in claim 31 in which the fourth voltage is derived from one of a voltage reference and the unregulated DC input voltage.

34. A voltage regulating circuit as claimed in claim 33 in which the first is configured to compare the third voltage indicative of the voltage on the primary node with the unregulated DC input voltage.

35. A voltage regulating circuit as claimed in claim 29 in which the secondary control circuit comprises a second compare circuit configured to compare a first voltage indicative of the output voltage with a second voltage, and to produce a second control signal indicative of the difference between the first voltage and the second voltage.

36. A voltage regulating circuit as claimed in claim 35 in which the second voltage is derived from a first voltage reference.

37. A voltage regulating circuit as claimed in claim 35 in which the second voltage is derived from one of a voltage reference and the unregulated DC input voltage.

38. A voltage regulating circuit as claimed in claim 35 in which the second control signal is applied to the secondary pass element, and the impedance of the secondary pass element is responsive to the second control signal.

39. A method for producing a regulated DC output voltage from an unregulated DC input voltage, the method comprising:

providing a primary current path in a voltage regulating circuit for accommodating current from a first one of a pair of input terminals to a first one of a pair of output terminals, providing a primary current path in a voltage regulating circuit for accommodating current from a first one of a pair of input terminals to a first one of a pair of output terminals, the primary current path including a primary pass element of variable impedance on a die, and a voltage dropping heat dissipating impedance element in series with the primary pass element to define with the primary pass element a primary node therebetween in the primary current path, the voltage dropping heat dissipating impedance element being external to the die;

providing a bypass current path in parallel with the primary current path bypassing the voltage dropping heat dissipating impedance element, the bypass current path including a secondary pass element of variable impedance, wherein the secondary pass element is in parallel with the voltage dropping heat dissipating impedance element;

controlling the impedance of the primary pass element in response to one of the voltage produced across the output terminals, for maintaining the output voltage across the output terminals at the regulated voltage value, and the voltage on the primary node, for controlling the voltage on the primary node; and controlling the impedance of the secondary pass element in response to the other of the voltage produced across the output terminals, for maintaining the output voltage across the output terminals at the regulated voltage value, and the voltage on the primary node, for controlling the voltage on the primary node.

* * * * *